United States Patent [19]

Hargest et al.

[11] Patent Number: 5,029,352

[45] **Date of Patent: * Jul. 9, 1991**

[54] DUAL SUPPORT SURFACE PATIENT SUPPORT

[75] Inventors: Thomas S. Hargest; Sohrab Soltaninasab; Robert C. Novack, all of Charleston, S.C.

[73] Assignee: SSI Medical Services, Inc., Charleston, S.C.

[ * ] Notice: The portion of the term of this patent subsequent to Jul. 24, 2007 has been disclaimed.

[21] Appl. No.: 480,216

[22] Filed: Feb. 14, 1990

Related U.S. Application Data

[63] Continuation-in-part of Ser. No. 288,071, Dec. 20, 1988, Pat. No. 4,942,635.

[51] Int. Cl.[5] ..... A47C 27/10; A47G 7/04; A47G 7/057

[52] U.S. Cl. ..... 5/453; 5/455

[58] Field of Search ..... 5/453, 455, 449, 469, 5/450; 297/DIG. 4

[56] References Cited

U.S. PATENT DOCUMENTS

| | | | |
|---|---|---|---|
| 3,047,888 | 8/1962 | Shecter et al. . | |
| 3,051,601 | 8/1962 | Schick . | |
| 3,428,973 | 2/1969 | Hargest et al. | 5/450 |
| 3,553,749 | 1/1971 | Majeske . | |
| 3,585,660 | 6/1971 | Gottfried et al. . | |
| 3,585,661 | 6/1971 | Gottfried et al. . | |
| 3,833,259 | 9/1974 | Pershing . | |
| 3,866,606 | 2/1975 | Hargest | 128/71 |
| 4,163,297 | 8/1979 | Neumark | 5/455 |
| 4,483,029 | 11/1984 | Paul | 5/453 |
| 4,564,965 | 1/1986 | Goodwin | 5/453 |
| 4,599,755 | 7/1986 | Tominage | 5/453 |
| 4,637,083 | 1/1987 | Goodwin | 5/453 |
| 4,672,699 | 6/1987 | Goodwin | 5/430 |
| 4,694,520 | 9/1987 | Paul et al. | 5/453 |
| 4,694,521 | 9/1987 | Tominage | 5/453 |
| 4,745,647 | 5/1988 | Goodwin | 5/453 |
| 4,768,249 | 9/1988 | Goodwin | 5/453 |

*Primary Examiner*—Alexander Grosz
*Attorney, Agent, or Firm*—Dority & Manning

[57] ABSTRACT

A patient support system has a first surface formed by one or more of a choice of structures. A fluidizable surface formed by air fluidizing a mass of fluidizable material is disposed adjacent the first surface. Examples of structures suitable for the first surface include a conventional mattress, with or without springs, polyurethane foam, and a plurality of inflatable sacks. The structure forming the first surface can be disposed on an articulatable member. The two surfaces are disposed end to end, and preferably the fluidized material supports at least the buttocks of the patient. the fluidizable material is laterally restrained by a member which is at least partially, vertically collapsible so as to facilitate the patient's ingress and egress to and from the support system. An interface member such as an inflatable sack, a non-rigid panel or a polyurethane foam member forms the part of the lateral restraint member which connects the two surfaces. The collapsible member can comprise an air impermeable panel which can form an inflatable elastic wall having one or more internal webs defining separately pressurizable compartments. A blower inflates the sacks, the elastic wall, and the fluidizable material via a network including manifolds, valves, and flexible tubing. A microprocessor controls actuation of the various valves and the blower according to signals inputted by operating personnel or supplied by various sensors which monitor the patient support system.

34 Claims, 13 Drawing Sheets

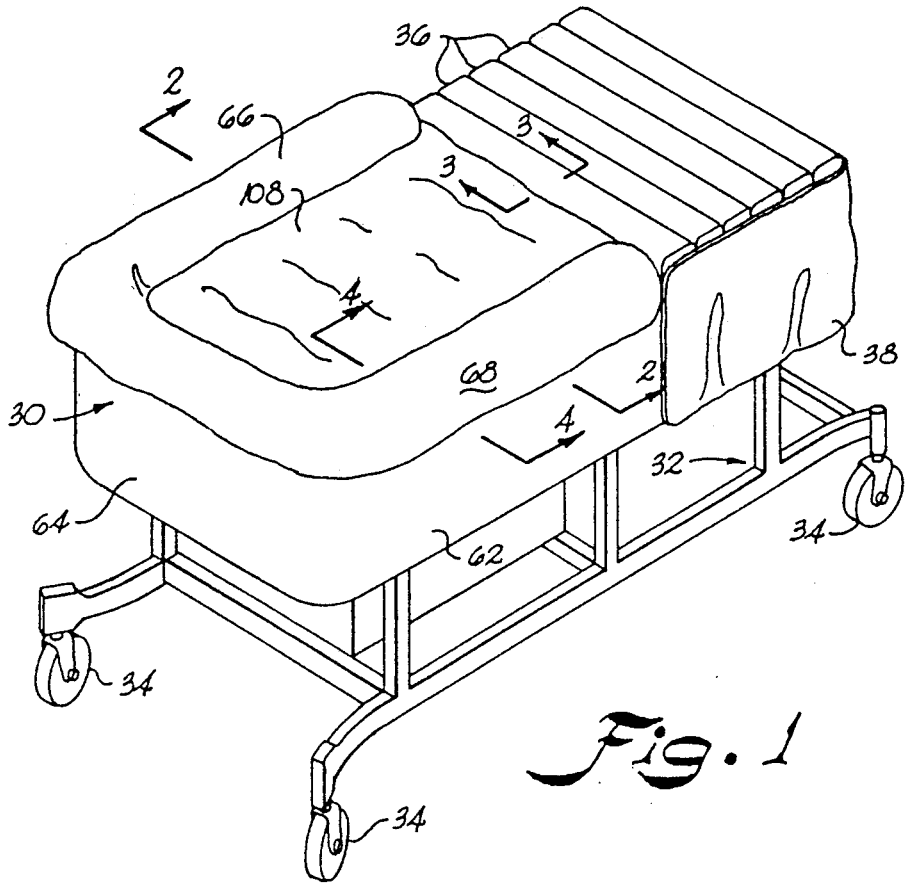
Fig. 1
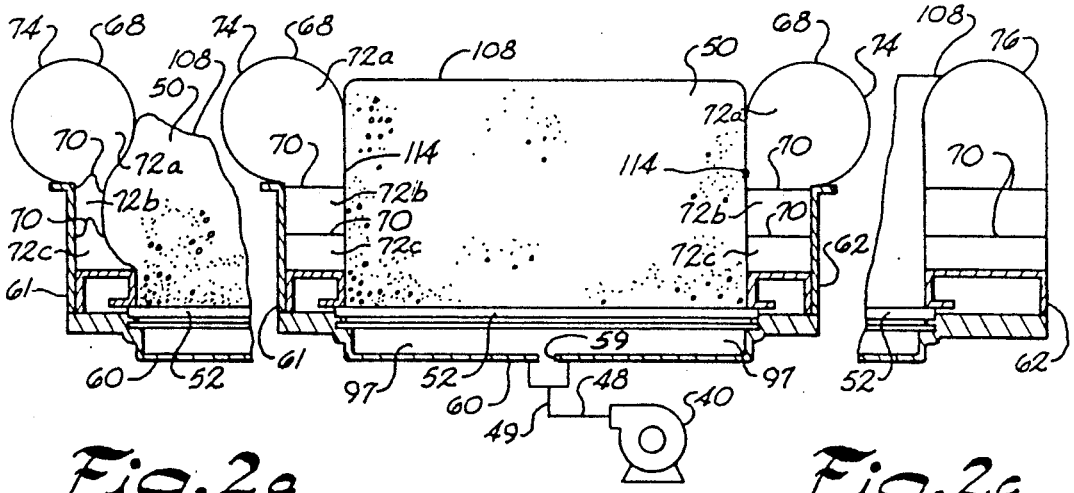
Fig. 2a
Fig. 2c
Fig. 2b

DUAL SUPPORT SURFACE PATIENT SUPPORT

BACKGROUND OF THE INVENTION

The present invention relates to patient support systems and more particularly to a patient support system which combines attributes of a fluidized air bed and a low air loss bed. This is a continuation-in-part application to application Sr. No. 288,071, filed on Dec. 20, 1988 now U.S. Pat. No. 4,942,635, application Ser. No. 07/377,427 filed on July 7, 1989 now U.S. Pat. No. 4,914,760, application Ser. No. 07/443,661 filed on Nov. 29, 1989 now U.S. Pat. No. 4,967,431 and application Ser. No. 07/446,987 filed on Dec. 6, 1989, all of which applications are hereby incorporated herein by reference.

Two types of patient support systems preferred for long-term patient care include air fluidized beds such as those described in Hargest et al U.S. Pat. No. 3,428,973 and Hargest U.S. Pat. No. 3,866,606, Paul U.S. Pat. No. 4,483,029, Goodwin U.S. Pat. Nos. 4,564,965, 4,637,083 and 4,672,699, and low air loss beds such as those described in Paul et al U.S Pat. No. 4,694,520, Goodwin U.S. Pat. Nos. 4,745,647 and 4,768,249.

Each type has advantages for particular segments of the patient population. For example, patients with respiratory problems require elevation of the chest. However, this tends to cause the patient to slide toward the foot of the bed. Since a fluidized bed in the fluidized condition provides no shear forces against the patient, and some shear forces are provided by the low air loss bed, patient elevation is performed more easily in a low air loss bed. However, to completely overcome this slippage, some sort of knee gatch is required to be fitted to the bed to provide a surface against which the buttocks of the patient may be retained when the patient's chest is elevated.

Moreover, the same shear forces which assist in retaining the patient in the low air loss bed from slipping to the foot of the bed when the chest is elevated, become undesirable for patients with skin grafts. The shear forces tend to tear such skin grafts from the patient, and this is not only painful but also interrupts the healing process. The absence of shear forces in a fluidized bed permits the patient with skin grafts to move about without fear that the grafts will be torn from the patient's body. In a fluidized bed, the patient can lie on a skin graft and be confident that when the patient moves, the sheet will move with the patient across the supporting mass of fluidized material and not displace the graft as would be the case if the patient were moved across a conventional mattress or a low air loss bed support for that matter.

The large mass of fluidizable material required to sustain operation of a fluidized bed contributes significantly to the weight of the bed. In addition, the large mass of fluidizable material requires a large blower to fluidize the beads, and such blowers require significant amounts of electricity for their operation.

The sides of a fluidized bed are rigid to retain the fluidizable material and to attach the cover sheet thereto. Ingress to and egress from the fluidized bed by patients must be performed with due regard to the rigidity of the sides of the bed.

The fluidizable material in a fluidized bed can be soiled and must be removed for cleaning at regular intervals and when particular circumstances dictate. Because of intermixing of the fluidizable material during fluidization, a localized soiling becomes distributed throughout the mass of material. Removal of the entire mass of material for cleaning is a time consuming and labor intensive task.

PRINCIPAL OBJECTS AND SUMMARY OF THE INVENTION

It is a principal object of the present invention to provide an improved patient support system for long-term patient care.

It is a further principal object of the present invention to provide an improved patient support system providing fluidized patient support, yet facilitating elevation of the patient's upper body.

It is another principal object of the present invention to provide an improved patient support system providing fluidized patient support that reduces the overall weight of the system.

A further principal object of the present invention is to provide an improved patient support system providing fluidized patient support that reduces the overall power requirements of fluidizing the system.

Another principal object of the present invention is to provide an improved patient support system providing fluidized patient support that facilitates patient entry to and egress from the system.

A still further principal object of the present invention is to provide an improved patient support system providing fluidized patient support that facilitates removal of the fluidizable material and more economic maintenance of same.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the dual mode patient support system of the present invention comprises a frame which carries a first surface to support at least a first portion of the patient's body and preferably the head, chest, and upper torso of the patient. This first surface is preferably formed at least in part by a mattress including such materials as textile fibers. Alternatively, the first surface is preferably formed at least in part by a polyurethane foam member. Any surface capable of supporting at least a portion of the patient's body likely could be used to form the first surface.

In further accordance with the present invention, the frame carries a fluidizable medium that supports another portion of the patient's body and preferably the buttocks, legs, and feet of the patient. The fluidizable medium preferably includes tiny spheres formed of glass, ceramics, and/or silicon.

In yet further accordance with the present invention, the frame carries means for supporting the fluidizable medium and for permitting the diffusion of air therethrough. Preferably, the means for supporting the fluidizable medium and for permitting the diffusion of air therethrough includes a diffuser board permeable to air but impermeable to the fluidizable medium. The fluidizable material is carried by the diffuser board.

In still further accordance with the present invention, means are provided for laterally retaining the fluidizable medium generally above the supporting and diffusing means. As embodied herein, the laterally retaining means preferably includes a selectively collapsible elastic wall surrounding the supporting and diffusing means and extending in a direction substantially normally to the supporting and diffusing means. In addition, the retaining means preferably is secured to the diffuser board in airtight fashion. Preferably, at least a portion of the elastic wall separates the fluidizable medium from the first surface.

The apparatus of the present invention further preferably includes a cover sheet to assist in containing the fluidizable medium. The cover sheet encloses the fluidizable material by being connected to the retaining means in a fashion that is impermeable to the passage of fluidizable material.

The supporting and diffusing means, the laterally retaining means, and the cover sheet combine to form means for containing the fluidizable medium and for permitting the diffusion of air through the fluidizable medium. Thus, the containing and diffusing means preferably provides a supporting and diffusing means to carry the fluidizable material. The supporting and diffusing means is impermeable to the fluidizable material, while being permeable to air to permit the introduction of air amidst the fluidizable material to fluidize same. The containing and diffusing means further includes a cover sheet that is permeable to air but impermeable to the fluidizable medium. The cover sheet and supporting and diffusing means are connected by a wall surrounding the fluidizable medium and retaining the fluidizable medium from spreading in the lateral direction.

Means are provided for detachably attaching the periphery of the air permeable cover sheet to the retaining means so as to prevent passage of the fluidizable material past this sheet attaching means. The sheet attaching means preferably includes an attachment mechanism such as an airtight zipper or a mating elastomeric interlocking mechanism. One of the engagable components of the zipper or interlocking mechanism can be secured to the end of an attachment flap that is secured to the retaining means. The attachment flap preferably is both air impermeable and impermeable to the passage of fluidizable material therethrough.

The retaining means preferably includes an elastic wall which takes the form of a number of different embodiments. In one embodiment, the elastic wall includes an inflatable U-shaped member with an inflatable interface sack at the open end of the U-shaped member. The U-shaped member and the interface sack can have one or more internal webs defining separately pressurizable compartments therewithin. In addition, deformable inserts can be disposed to fill the compartments. In another embodiment of the elastic wall, the open end of the U-shaped member is sealed by a non-rigid panel which is impermeable to the passage of both air and fluidizable material therethrough. In yet another embodiment, the elastic wall is defined by a non-rigid panel completely surrounding the fluidizable material. A portion of the panel is supported by the inflatable sacks, while the remainder of the panel is supported by a rigid sidewall which is selectively collapsible either by a grooved track mechanism or a bottom-hinged mechanism. The collapsibility of the retaining means embodiments greatly facilitates patient ingress to and egress from the dual mode patient support system of the present invention.

It is important that the air passing through the diffuser board is constrained to pass through the fluidizable medium to fluidize same. The elastic wall preferably has an attachment flap with an anchoring member at the free end thereof for anchoring the flap against the edge of the diffuser board, which then is further sealed by a silicone rubber sleeve around the free edge of the diffuser board and a bead of room temperature vulcanizing compound.

In still further accordance with the present invention, means are provided for defining an air plenum beneath the supporting and diffusing means. Preferably, the diffuser board defines the upper member of an air plenum to which air is supplied and diffuses through the diffuser board to fluidize the fluidizable material supported thereabove. The lower portion of the air plenum preferably is formed by a tank having a bottom and sides extending substantially vertically from the bottom of the tank. One end of the tank preferably is open to accommodate the interface member.

Means are provided to supply air to the plenum for fluidizing the fluidizable medium. The means for supplying air to the plenum for fluidizing the fluidizable medium preferably includes a blower, a blower manifold, a fluidization supply manifold, one or more flow control valves, and a plurality of flexible air conduits. Each flow control valve provides means for supplying air to each plenum chamber at an independently preselected pressure. The diffuser board preferably has at least two tiers disposed at two different levels above the bottom of the plenum, which is subdivided into at least two chambers that are separately pressurizable from one another. One tier is disposed to support the fluidizable material that supports the patient's buttocks, and this tier is closer to the bottom of the plenum and therefore supports a relatively larger depth of fluidizable material than the second tier which supports the fluidizable material beneath the legs and feet of the patient. The reduced depth of material for supporting the legs and feet of the patient reduces the weight of the system. It also enables use of a smaller blower, and this lowers the power requirements of the system as well as further reducing the weight of the system.

Preferably, pressure is maintained in the inflatable components of the support system by connecting the blower to a main air supply manifold which supplies air to the pressure control valves via a plurality of flexible air conduits.

Each component or group of components which is desired to be maintained at a controllable pressure or flow rate is connected to the blower via an individual pressure control valve or flow control valve, respectively. Each valve has a pressure sensing device that measures the pressure at the outlet of each valve, which also is opened or closed to varying degrees by a motor. A microprocessor preferably controls the various valves to control the pressure provided to the inflatable components. For example, the microprocessor controls the rate of flow of air provided to the plenum which fluidizes the fluidizable material. The microprocessor receives pressure information from each valve via the pressure sensing device and controls the motor to open or close the valve accordingly. The microprocessor is programmed to control each valve according to the desired pressure or flow rate behavior for that particular component. Accordingly, each valve defines its own particular zone which is subject to individual control by the microprocessor. The microprocessor stores various control programs that can be activated via the key pad and control panel. The operating parameters for each control program can be inputted as desired by a key pad and control panel connected to the microprocessor.

One of the operational programs for the microprocessor is the continuous mode of fluidization of the fluidizable material. Air can be continuously supplied to the plenum at a minimum mode of fluidization, a maximum mode of fluidization, and an intermediate mode of fluidization. In addition, the microprocessor can supply air to the plenum so as to intermittently fluidize the fluidizable material. This is accomplished by the microprocessor, which is programmed to turn off the fluidization for a short interval of time followed by fluidizing for a brief interval of time and repeating this sequence again and again.

Each control valve can be operated in a mode which instantaneously opens the valve. This mode of operation is useful for depressurizing an inflatable sack to facilitate an emergency medical procedure requiring a rigid surface rather the compressible surface afforded by the inflatable sacks. The instantaneous depressurization can be controlled by the key pad of the control panel of the microprocessor.

The microprocessor controls the overall pressure and flow rates of air being supplied to the patient support system by controlling the blower via a blower control board that receives signals from a pressure sensor which monitors the pressure at the outlet side of the blower.

In an alternative embodiment, means are provided for containing the fluidizable medium and permitting the diffusion of air therethrough. As embodied herein, the means for containing the fluidizable medium and permitting the diffusion of air therethrough preferably includes a plurality of discrete fluidizable cells. Each cell has an upper wall, a lower wall, and a side wall extending between the upper wall and the lower wall. Each cell contains a mass of fluidizable material therewithin, and the walls prevent the passage of this fluidizable material therethrough. The upper wall and the lower wall are permeable to the passage of air therethrough, but the side wall is not. The upper wall of each cell is preferably formed as a detachably engagable section of an air permeable cover sheet. The peripheries of the cells are connected to the retaining means in detachable fashion and also connected to one another in the same detachable fashion. The lower walls of each cell are maintained against the diffuser board and detachably anchored thereto so that air passing through the diffuser board most pass through the lower walls of the cells and thereby fluidize the fluidizable material therewithin.

The means for detachably connecting the fluidizable cells to the diffuser board and one another preferably includes one or more attachment flaps, anchoring flaps, and attachment mechanisms. As to the latter, an air impermeable zipper or an airtight elastomeric interlocking mechanism is preferred. The upper portions of adjacent cells also can be connected by hook and loop strips, such as VELCRO strips, extending along their sidewalls.

The detachably connecting means of the fluidizable cells and the detachably attachment means of the cover sheet greatly facilitate removal of the fluidizable medium for cleaning, and the cells prevent localized soiling from being distributed throughout the medium.

A heat exchange device can be provided to regulate the temperature of the air being used to fluidize the mass of fluidizable material.

In further accordance with the present invention, an articulatable member is attached to the frame and is used to support the first surface thereon. In such articulatable embodiments, means are provided for defluidizing the mass of fluidizable material during elevation of the articulatable member. As embodied herein, the defluidizing means preferably includes conventional hydraulics and motors which are used to effect articulation of the articulatable member. These hydraulics and motors are under the control of the microprocessor. In addition, a sensing device monitors the degree of articulation of the articulatable member and furnishes this information to the microprocessor. The operator selects the degree of elevation of the articulation member via the key pad and control panel, and the microprocessor then activates the hydraulics and motors until the articulation sensing device signals that the desired level of articulation has been attained. In conjunction with the elevation of the articulatable member, the microprocessor preferably closes the flow control valve that governs the fluidization of the plenum chamber responsible for supplying air to fluidize the mass of fluidizable material beneath the buttocks of the patient. This defluidizes the mass of fluidizable material supporting the buttocks of the patient. The defluidized material beneath the buttocks of the patient acts to prevent the buttocks from moving in a direction toward the feet of the patient as weight is transferred against the buttocks during elevation of the head and chest of the patient. Thus, the defluidization of the mass of fluidizable material supporting the buttocks acts as a substitute for a knee gatch that often is required when elevating the head and chest of a patient in a conventional bed. Preventing movement of the buttocks provides the additional benefit of restraining the patient from any slipping and sliding that might cause tissue damage to any sacral skin grafts which may exist on the patient.

Moreover, after the articulatable member has attained the desired angle of elevation, the microprocessor opens the valves supplying air to the mass of fluidizable material so as to refluidize the material. Alternatively, the microprocessor can be programmed to cause only a brief fluidization of the fluidizable material supporting the buttocks of the patient. The duration of this brief fluidization is no longer than required to contour the mass of fluidizable material supporting the buttocks in the sitting position. The fluidization is brief enough so that the patient does not feel the sensation of sinking into the mass of fluidizable material in the buttocks zone during defluidization.

The accompanying drawings which are incorporated in and constitute a part of this specification, illustrate one embodiment of the invention and, together with the description, serve to explain the principles of the invention.

BRIEF DESCRIPTION OF THE DRAWINGS

FIG. 1 illustrates a perspective view of an embodiment of the present invention;

FIG. 2*a* illustrates a partial cross-sectional view of components of an embodiment of the present invention in a defluidized state taken along the lines 2—2 of FIG. 1;

FIG. 2*b* illustrates a cross-sectional view of components of an embodiment of the present invention in a fluidized state taken along the lines 2—2 of FIG. 1;

FIG. 2*c* illustrates a partial cross-sectional view of components of an embodiment of the present invention in a fluidized state taken in a direction similar to the lines 2—2 of, FIG. 1;

DETAILED DESCRIPTION OF THE PREFERRED EMBODIMENTS

Figure 3A:
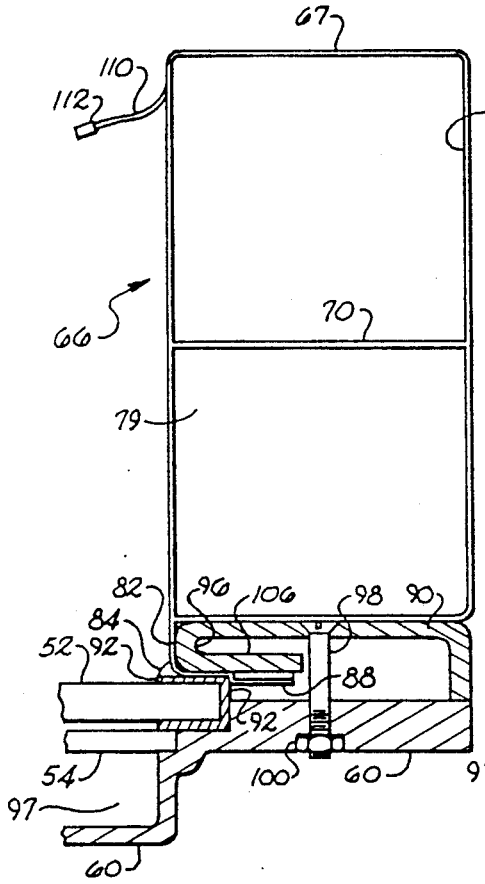
FIG. 3*a* illustrates a detailed cross-sectional view of components of an embodiment of the present invention taken in a direction similar to the lines 3—3 of FIG. 1.

Reference now will be made in detail to the presently contemplated preferred embodiments of the present invention, examples of which are illustrated in the accompanying drawings.

FIG. 1 illustrates a preferred embodiment of the dual mode patient support system of the present invention, which is represented generally by the numeral 30. Typical overall dimensions for the patient support system are thirty-six inches in width and ninety inches in length.

In accordance with the patient support system of the present invention, a frame is provided and is indicated generally in FIG. 1 by the designating numeral 32. Frame 32 can be provided with a plurality of rolling casters 34 for facilitating movement of patient support system 30. The diameter of the rotating member of each caster 34 preferably is a minimum of six and one half inches, and each caster 34 is preferably springloaded. Frame 32 preferably is constructed of rigid material such as tubular or angled metal capable of supporting the weight of the components carried thereon.

Figure 10:
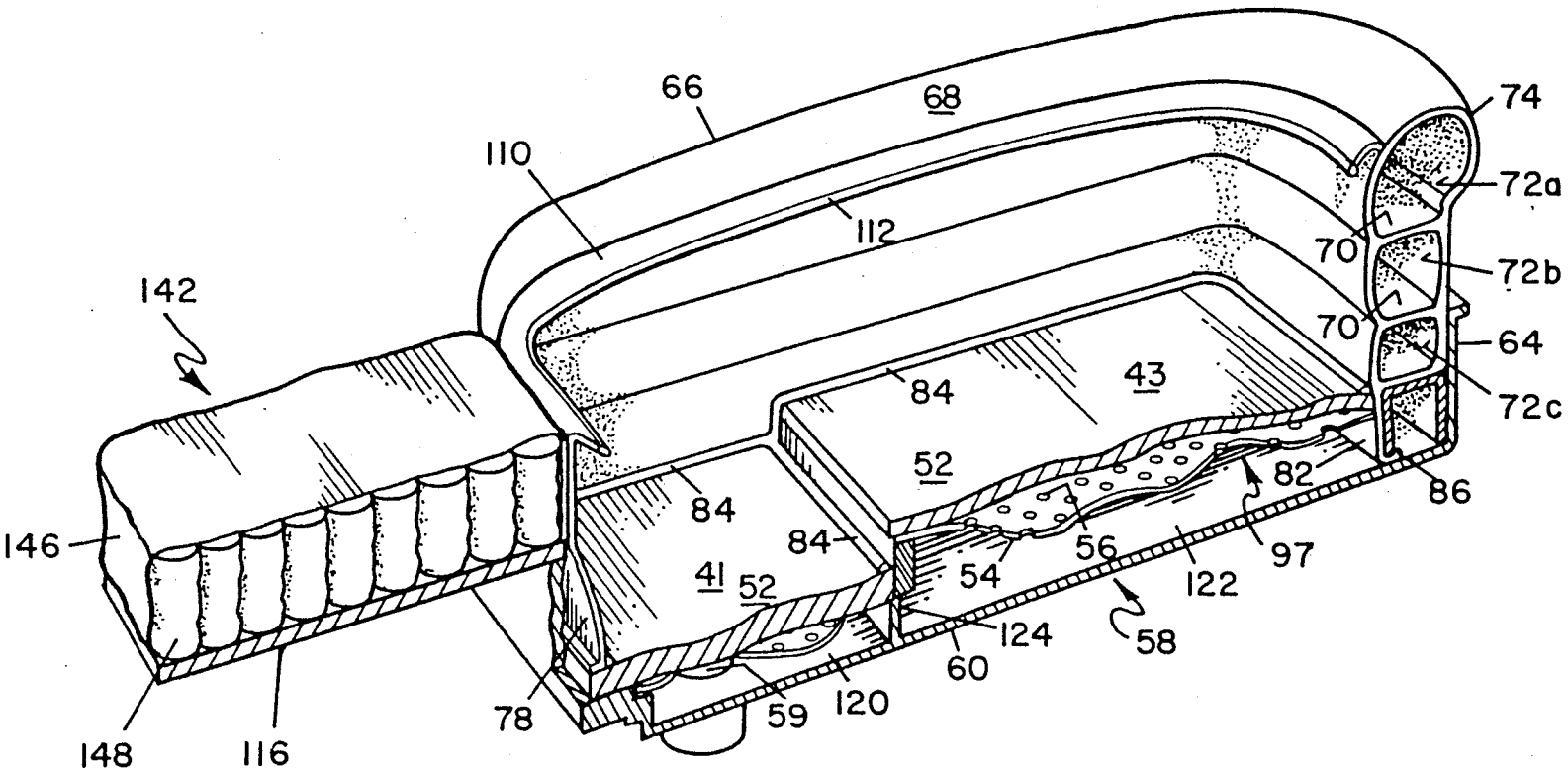
FIG. 10 illustrates a perspective, cut-away view of components of an embodiment of the present invention.
Figure 11:
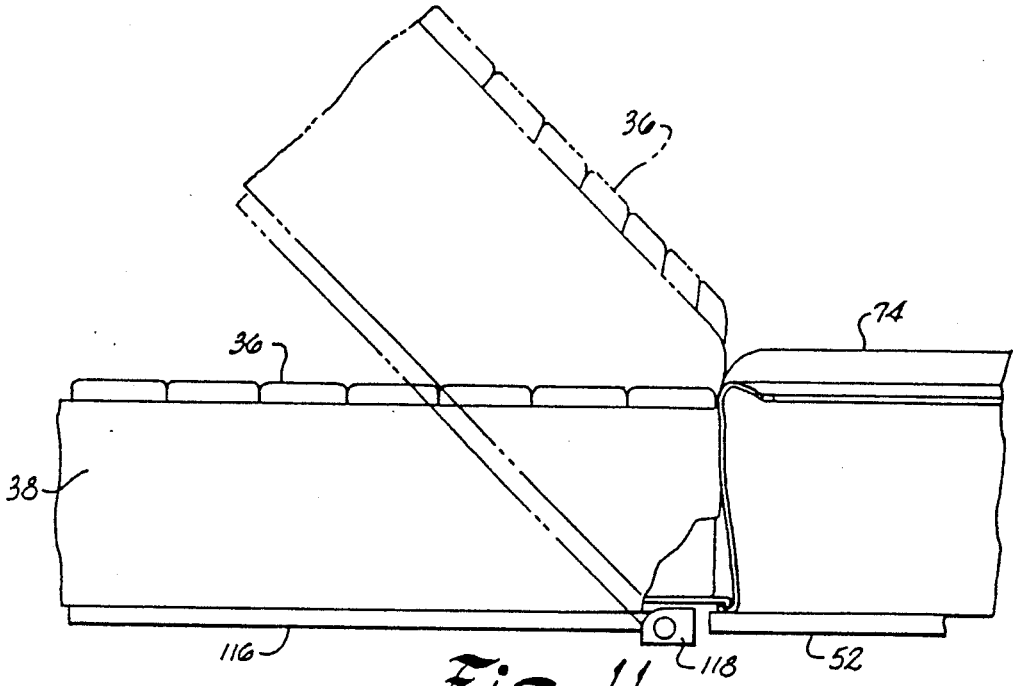
FIG. 11 illustrates a side, partially cut-away, plan view of components of an embodiment of the present invention.

As shown in FIGS. 10 and 11 for example, frame 32 includes an articulatable member 116. Conventional means such as hydraulics and motors are provided to raise and lower the articulatable member, which pivots about an articulation joint 118. Preferably, member 116 has a range of inclination from 0° to 60° from the horizontal.

Figure 16:
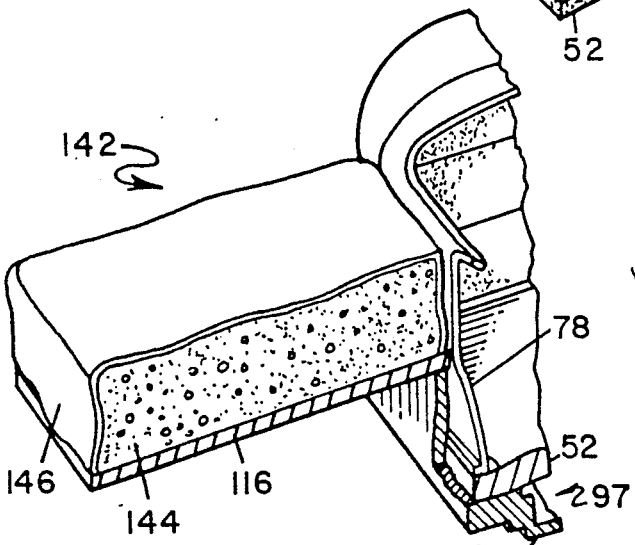
FIG. 16 illustrates a perspective view of an alternative preferred embodiment of the present invention.

In further accordance with the present invention, there is provided at least a first surface carried by the frame to support at least a first portion of the patient's body. Preferably, the first portion of the patient's body includes the patient's head and chest. However, other portions of the patient's body can be supported by the first surface, depending on the particular embodiment of the invention. As embodied herein and shown for example in FIG. 16, the frame carries a first surface carried by and supported above articulatable member 116. The first surface preferably is formed by a mattress, which is indicated generally in FIGS. 10 and 16 by the designating numeral 142. As shown in FIG. 10 for example, mattress 142 can be a conventional mattress filled with coiled springs 148, etc. As shown in FIG. 16 for example, mattress 142 can preferably be formed of a polyurethane foam filling 144 encased in a conventional covering 146 formed of ticking for example. Mattress 142 also can be filled with conventional fiber filling (not shown). The head and upper torso of a patient preferably rests atop mattress 142, which preferably is covered by a conventional hospital sheet and/or other bedding (not shown).

Figure 17:
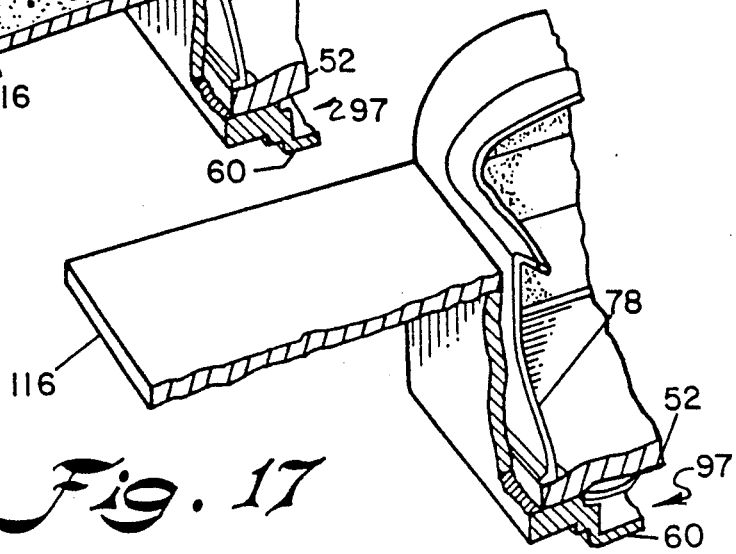
FIG. 17 illustrates a perspective view of another alternative preferred embodiment of the present invention.

In an alternative embodiment shown for example in FIG. 17, frame 32 carries a first surface formed as a flat and rigid member such as articulatable member 116. The upper torso of a patient preferably can be supported atop member 116, which can be covered by a conventional hospital sheet and/or other bedding or padding (not shown).

In another alternative embodiment shown for example in FIG. 1, frame 32 carries a first surface formed as a plurality of inflatable sacks 36 disposed transversely across articulatable member 116. The head and upper torso of a patient preferably rests atop inflatable sacks 36, which preferably are covered by a conventional hospital sheet and/or other bedding (not shown). A continuous retaining panel 38 preferably is attached to sacks 36 and surrounds same to retain same together in an orderly fashion. Any conventional means of attachment such as snaps or zippers can be used to connect retaining panel 38 to sacks 36. Each sack 36 preferably is ten and one-half inches in height measured above articulatable member 116 and about thirty-three and one half inches long measured in a direction transversely across member 116. The thickness of each sack 36 is approximately four and one-half inches. As illustrated in FIG. 11 for example, elevation of member 116 from the horizontal position deforms the two sacks closest to the articulation joint 118 to accommodate the change in position of member 116.

In further accordance with one alternative embodiment of the present invention, means are provided for maintaining a preselected pressure in each inflatable sack 36. As embodied herein and shown schematically in FIG. 15 for example, the means for maintaining a preselected pressure in each inflatable sack includes a blower 40, a blower manifold 42, a main air supply manifold 44, a plurality of pressure control valves 46, and a plurality of air impermeable tubes 48. Tubes 48 connect blower manifold 42 to blower 40 and to main air supply manifold 44, and connect pressure valves 46 to main air supply manifold 44 and to sacks 36. As 10 shown for example in FIG. 13, which schematically illustrates electrical pathways, each pressure control valve 46 preferably includes a pressure transducer 127 which monitors the pressure at the outlet of valve 46. Each valve 46 further preferably includes an electric motor 132 to regulate the flow permitted to pass through valve 46 and accordingly the pressure being sensed by transducer 127.

Figure 13:
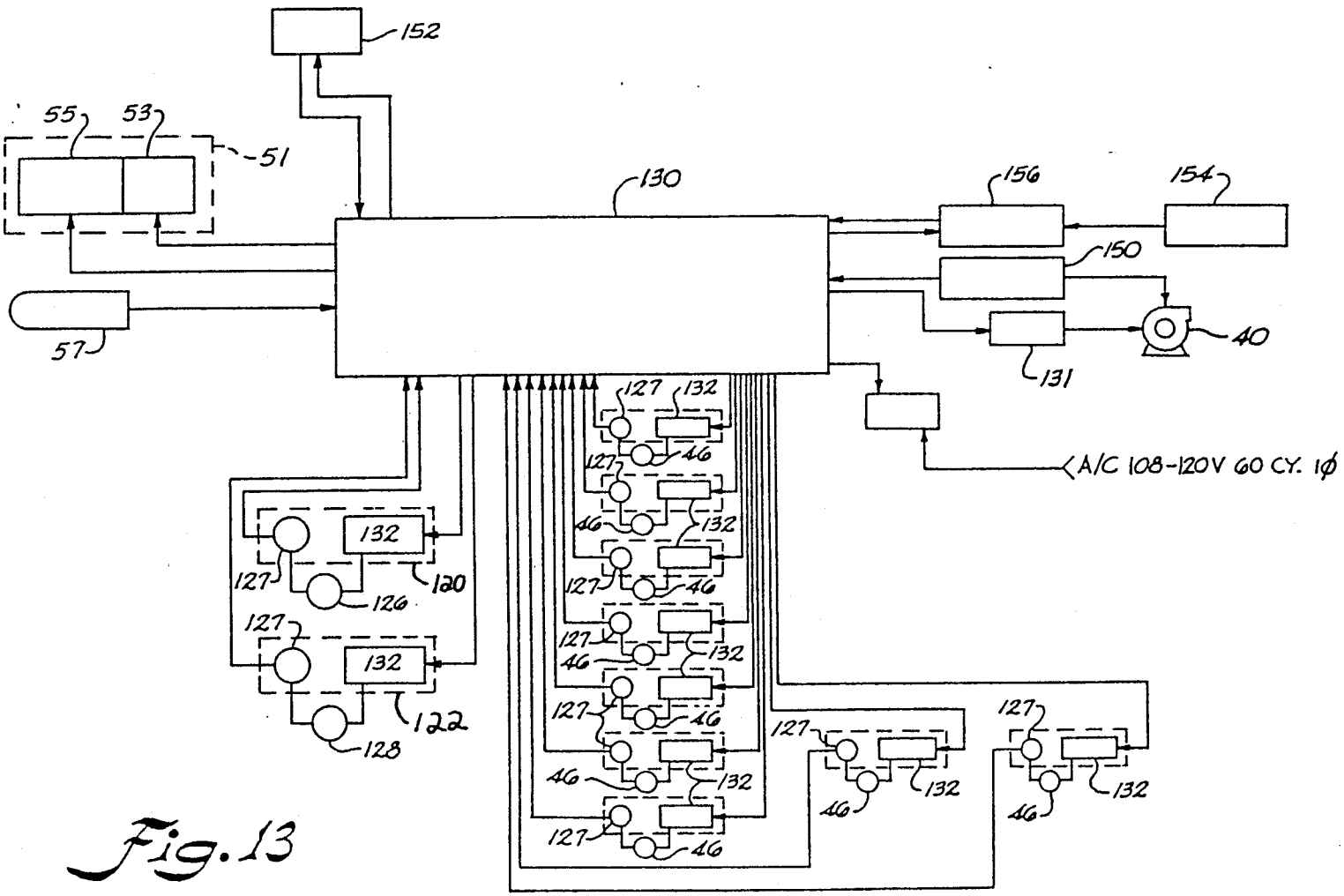
FIG. 13 illustrates a schematic diagram of components of an embodiment of the present invention.

As embodied herein and shown schematically in FIG. 13 for example, the means for maintaining a preselected pressure in each inflatable sack further includes a microprocessor 130. Pressure transducer 127 sends a signal to microprocessor 130 indicative of the pressure at the outlet of valve 46. Microprocessor 130 compares this signal to a signal stored in its memory corresponding to a preset pressure for that particular valve 46. Depending upon the results of the comparison, microprocessor 130 controls motor 132 to open or close valve 46 until the comparison indicates that the preset pressure has been attained. As shown in FIG. 13 for example, the preset pressure for each valve can be stored in the memory of microprocessor 130 via a key pad 154 and a control panel 156.

In yet further accordance with the present invention, a second surface formed by a fluidizable medium is carried by the frame adjacent the first surface to support at least a second portion of the patient's body. As embodied herein and shown in FIGS. 2*a*, 2*b*, 4, 8, 9, 12*a*, 12*b*, and 12*c* for example, a plurality of tiny particles 50 forms a fluidizable medium. Preferably, each particle 50 is formed as a sphere having a diameter on the order of one thousandth of an inch, or more specifically 50 to 150 microns. Suitable materials for forming particles 50 include ceramics, glass, and silicon. Preferably a silicon coating is applied to glass beads or to ceramic beads.

Figure 7:
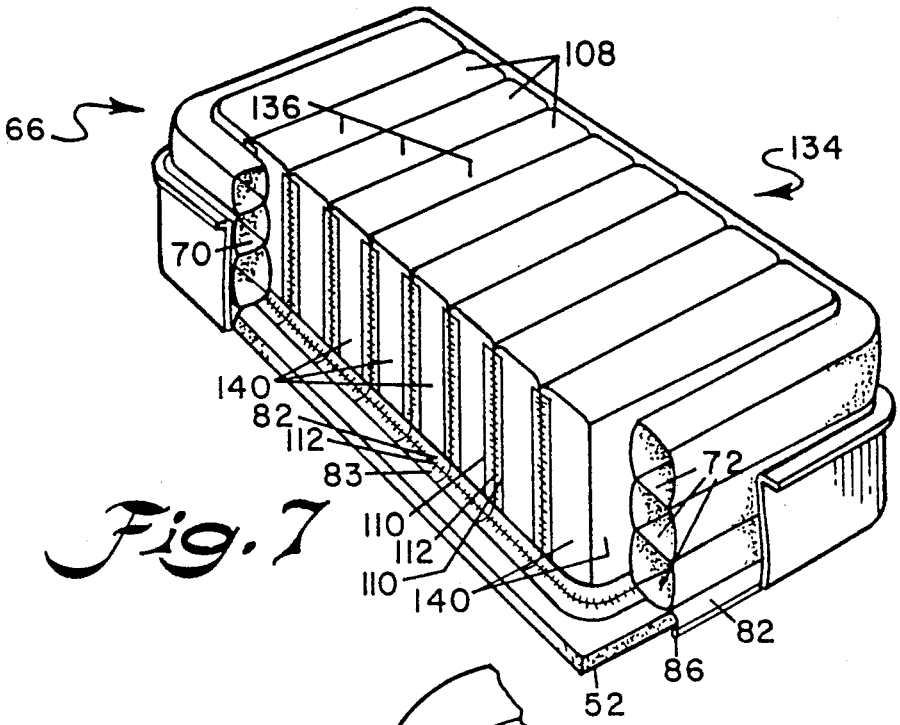
FIG. 7 illustrates a perspective, partially cutaway view of components of an embodiment of the present invention.
Figure 8:
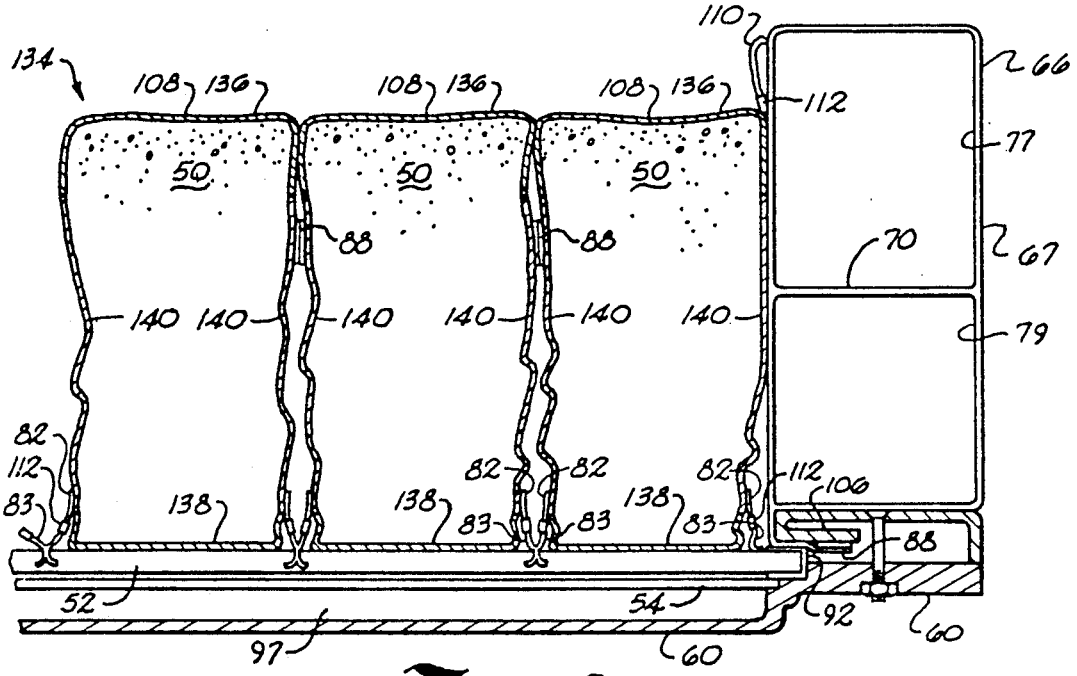
FIG. 8 illustrates a cross-sectional view of components of an embodiment of the present invention in a defluidized state.
Figure 9:
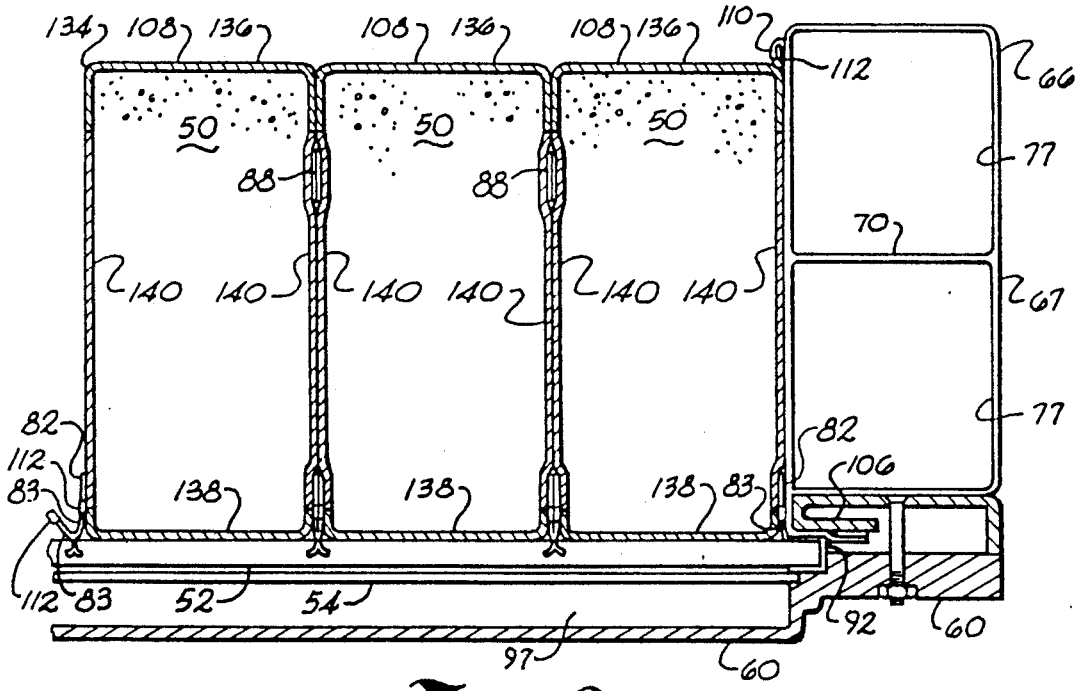
FIG. 9 illustrates a cross-sectional view of components of an embodiment of the present invention in a fluidized state.

As embodied herein and shown in FIGS. 10 and 16 for example, the first surface formed by mattress 142 is preferably disposed adjacent the fluidizable medium (not shown). Similarly, as shown in FIG. 17 for example, the first surface formed by articulatable member 116 is preferably disposed adjacent the fluidizable medium (not shown). In addition, as shown in FIGS. 1, 3*c*, 11 and 14 for example, the first surface formed by inflatable sacks 36 is preferably disposed adjacent the fluidizable medium, which is hidden by a cover 108 (described more fully hereafter) in the view shown in FIG. 1 and not shown in the cross-sectional view of FIG. 3*c*, the partial view of FIG. 11, or the perspective view of FIG. 14. In like fashion, as shown in FIGS. 7–9 for example, the first surface formed at least in part by inflatable elastic wall 66 is preferably disposed adjacent the fluidizable medium, which is contained within a plurality of adjacently disposed cells 134 (described more fully in copending application Ser. No. 07/443,661, filed on Nov. 29, 1989, entitled Fluidized Bed with Modular Fluidized Portion, which copending application is hereby incorporated herein by reference).

Moreover, the first surface preferably is disposed so that it begins supporting the patient's body where the fluidizable medium ends its support of the patient's body. Thus, the first surface and the fluidizable medium preferably are joined end-to-end to provide uninterrupted support for the patient's body. If the first surface is disposed to support the patient above the waist, then the second surface preferably is disposed to support the patient below the waist. The second portion of the patient, i.e., the portion supported by the fluidizable medium, preferably includes the buttocks, legs and feet of the patient.

In still further accordance with the present invention, means are provided for supporting the fluidizable medium and for permitting the diffusion of air through the fluidizable medium. Preferably, the supporting and diffusing means is carried by the frame. As embodied herein and shown in FIGS. 2*a*, 2*b*, 2*c*, 3*a*, 3*b*, 3*c*, 4, 6, 7, 8, 9, 10, 11, 12*a*, 12*b*, and 12*c*, the means for supporting the fluidizable medium and for permitting the diffusion of air therethrough preferably includes a diffuser board 52, which preferably is formed of particle board or other air-permeable material which also happens to be impermeable to the passage of particles 50 therethrough. Diffuser board 52 is carried by frame 32. In a preferred embodiment, a perforated metal plate 54 is provided beneath diffuser board 52 to support and reinforce same. As shown in FIG. 10 for example, perforated plate 54 includes a plurality of holes 56 extending through plate 54 to allow for passage of air therethrough. Perforated plate 54 is also carried by frame 32 and preferably is fabricated of a sturdy but light weight metal such as aluminum or light gauge steel.

In further accordance with the present invention, means are provided for defining at least one air plenum beneath the supporting and diffusing means. The air plenum defining means is carried by the frame and has a predetermined section through which air is permeable. As embodied herein and shown in FIGS. 2*a*, 2*b*, 2*c*, 3*a*, 3*b*, 4, 6, 10, 16, 17, 18, and 19, the air plenum defining means preferably includes diffuser board 52 and a tank indicated generally in FIG. 10 for example by the designating numeral 58. Diffuser board 52 preferably covers a bottom 60 of tank 58 to form the upper member defining an air plenum 97 therebetween and comprises the predetermined section of the plenum defining means through which air is permeable.

Tank 58 has a bottom 60, a pair of opposite sidewalls 61, 62 (FIG. 2*b*), and a closed end wall 64 (FIG. 1). Tank sidewalls 61, 62 and tank end wall 64 extend substantially in a direction normal to tank bottom 60. Sidewalls 61, 62 and end wall 64 preferably are integral and form a continuous wall disposed generally vertically relative to a horizontally disposed tank bottom 60. Tank 58 has an open top and can be at least partially open at one end thereof as in FIGS. 1, 10, 16, 17, 18 and 19, for example. Tank 58 can be formed of metal and preferably is formed of fiberglass or heat resistant plastic to reduce the overall weight of the dual mode patient support system. As shown in FIGS. *2b* and 10 for example, tank 58 has at least one opening 59 through tank bottom 60 through which air (other gases could be used) can be supplied to tank 58 and each air plenum. In a multi-plenum embodiment such as shown in FIG. 10, tank bottom 60 is provided with an opening for gas to enter each plenum. However, only one opening 59 is illustrated in the view shown in FIG. 10.

Figure 15:
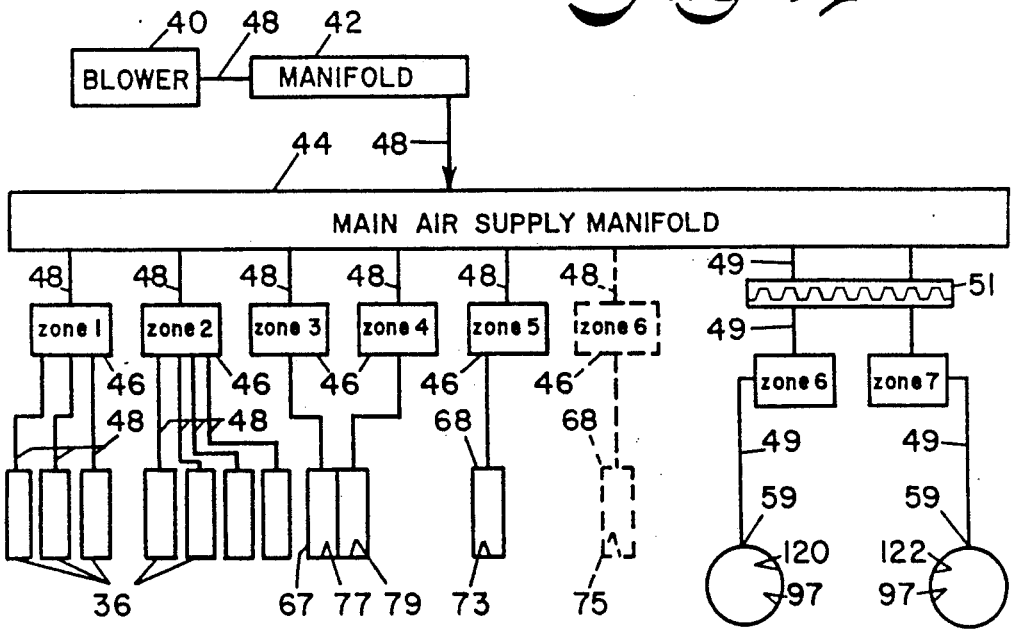
FIG. 15 illustrates a schematic diagram of components an embodiment of the present invention.

In a preferred embodiment of the present invention illustrated in FIGS. 10, 13, and 15 for example, the plenum 97 formed between tank bottom 60 and diffuser board 52 is divided into at least two separate plenum chambers 120, 122. This arrangement enables air to be supplied to one chamber at a different pressure than air is supplied to the other chamber or chambers. As shown in FIG. 10 for example, plenum chamber 120 is separated from plenum chamber 122 by an air impermeable divider 124. Preferably, at least one plenum chamber 120 is disposed to support the buttocks of the patient, and the second plenum chamber 122 is disposed to support the legs and feet of the patient. Preferably, the superficial flow rate and the pressure of the air supplied by blower 40 to the buttocks plenum chamber 120 can be regulated so as to be higher than that supplied to plenum chamber 122 for the legs and feet.

As embodied herein and shown in FIG. 10 for example, diffuser board 52 defines a first tier 41 and a second tier 43. First tier 42 defines the section of diffuser board 52 forming buttocks plenum chamber 120 and is disposed closer to tank bottom 60 than second tier 43, which defines the section of diffuser board 52 forming plenum chamber 122, and which is disposed to fluidize the material 50 supporting the legs and feet of the patient. Thus, a deeper mass of fluidizable material 50 is supported by first tier 41 of diffuser board 52 over buttocks plenum chamber 120 than is supported by second tier 43 of diffuser board 52 over leg and foot plenum chamber 122. In other words, the height of fluidizable material 50 is larger above first tier 41 of diffuser board 52 at buttocks plenum chamber 120 than above second tier 43 of diffuser board 52 at leg and foot plenum chamber 122.

A three inch differential in the height of the fluidizable material constitutes a very significant reduction in the weight of the patient support system. The typical width of the mass of fluidizable material is twenty-four to twenty-six inches, and the length of same is on the order of fifty-one inches. At a uniform depth of nine inches, these dimensions define a substantial volume of fluidizable material. In the embodiment of the present invention shown in FIG. 10 for example, the mass of fluidizable material supporting the patient's buttocks typically measures eighteen inches long in the direction parallel to the length of the patient support system, and the leg and foot zone is typically thirty-three inches long. The height of fluidizable material above buttocks plenum chamber 120 is nine inches, and the height above the leg and foot chamber 122 is six inches. Accordingly, two-tiered plenum embodiments such as shown in FIG. 10 result in the reduction of a volume of fluidizable material measuring eighteen inches by twenty-six inches by three inches. If the fluidizable material is formed of glass microspheres, this reduces the weight of the patient support system by about 150 pounds. Moreover, this reduction in the volume of fluidizable material permits use of a smaller blower, which weighs less and thus further reduces the overall weight of the system. Furthermore, a smaller blower lowers the power requirements for operating the system.

In yet further accordance with the present invention, means are provided for supplying air to fluidize the fluidizable medium. The fluidizing means can include the plenum and the air supplying means communicates therewith. As embodied herein and shown schematically in FIG. 15 for example, the means for supplying air to fluidize the fluidizable medium preferably includes blower 40, blower manifold 42, a main air supply manifold 44, one or more flow control valves 126, 128, and a plurality of flexible air conduits 48, 49. Air travels from blower 40 to plenum 97 via blower manifold 42, tubes 48, a main air supply manifold 44, control valves 126 or 128, and each opening 59 through tank bottom 60. Blower 40 preferably is capable of supplying forty cubic feet of standard air per minute to the plenum at a pressure of up to twenty-three inches of water, while simultaneously supplying air to air sacks 36 and any other components of the system which are inflatable or require air flow.

The fluidization of the mass of fluidizable material 50 preferably is carried out at different modes of fluidization. There are continuous modes of operation and intermittent modes of operation. In the continuous modes of operation, air is continuously supplied to flow through at least one plenum chamber. There are essentially four continuous modes of operation for fluidization. The zero mode of fluidization embodies the condition when the amount of air passing through the mass of fluidizable material is insufficient to fluidize same. This occurs when the superficial velocity of air through the flow area presented by the fluidizable material, as measured by the area of the underlying diffuser board, is on the order of 0.01 feet per second or less. At the minimum mode of fluidization, sufficient air is passing through the fluidizable material 50 to render same fluidized and thus reduce the shear forces to essentially zero. At the minimum mode of fluidization the superficial velocity of the air passing through the fluidizable material is on the order of 0.04 feet per second. The maximum mode of fluidization is that which renders the fluidization turbulent and occurs at about a superficial flow velocity of 0.07 feet per second. Accordingly, the intermediate mode of fluidization occurs between the minimum mode of fluidization and the maximum mode of fluidization and generally begins at a superficial velocity of about 0.05 feet per second. In the intermittent modes of operation, the air flow is turned off for an interval of time and then turned on for an interval of time. The repetition of this sequence constitutes an intermittent fluidization mode of operation.

In yet further accordance with the present invention, means are provided for independently supplying air to each plenum chamber at independently preselected air flow rates. As embodied herein and shown schematically in FIGS. 13 and 15 for example, the means for separately supplying air to each plenum chamber at independently preselected air flow rates includes a flow control valve 126 for regulating the supply of air to plenum chamber 120 and a flow control valve 128 for regulating the supply of air to plenum chamber 122. The means for independently supplying air to each separate plenum chamber at a separate flow rate further includes a microprocessor 130 programmed to regulate flow control valve 126 and flow control valve 28. The means for supplying air to each separate plenum chamber at a separate flow rate further includes a flow sensing device such as an air velocity sensing device 127 disposed to measure the flow of air at the outlet of each flow control valve 126, 128.

In still further accordance with the present invention, means also are provided for intermittently supplying air flow to at least one of plenum chambers 120, 122. In this way, the mass of fluidizable material disposed above at least one of plenum chambers 120, 122 and preferably one or both plenum chambers 120, 122 can be fluidized intermittently. As embodied herein and shown in FIGS. 13 and 15 for example, the means for intermittently supplying air flow to at least one plenum chamber preferably includes a microprocessor 130 controlling actuation of the flow control valve 126 or 128 which regulates air flow to the plenum chamber which is selected for an intermittent mode of air flow supply. Each plenum chamber 120, 122 is supplied with air through respective flow control valve 126, 128. The amount of air flow permitted to pass through each flow control valve 126, 128 is controlled by microprocessor 130 according to a preprogrammed set of instructions stored in the memory of microprocessor 130.

For example, during a given interval of time between one and five minutes, the appropriate flow control valve 126 or 128 is closed to prevent any air flow from reaching the respective plenum chamber 120 or 122. In other words, the fluidizable material supported above such plenum chamber is maintained in an unfluidized state. After the passage of this predetermined interval, which can be preset via a control panel which inputs the desired interval into the appropriate set of instructions stored in microprocessor 130, microprocessor 130 opens the appropriate flow control valve to permit at least a minimum level of fluidization of material 50 supported above the corresponding plenum chamber and maintains this minimum fluidization for about one-half to ten seconds for example. One or both or neither plenum chamber can be operated according to the intermittent mode of fluidization, as desired by selecting this mode on the control panel which sends the appropriate signal to microprocessor 130.

In further accordance with the present invention, means are provided for laterally retaining the fluidizable medium generally above the supporting and diffusing means and thus above the air plenum. The retaining means is carried by the frame. As embodied herein and shown in FIGS. 1, 2*a*, 2*b*, 2*c*, 2*d*, 3*a*, 3*b*, 3*c*, 4, 6, 7, 8, 9, 10, 11, 12*a*, 12*b*, 12*c*, 14, 16, 17, 18 and 19, for example, the means for retaining the fluidizable medium generally above the supporting and diffusing means preferably includes an elastic wall, which exists in a number of different embodiments. The means for laterally retaining the fluidizable medium generally above the supporting and diffusing means also can include a rigid wall member such as walls 61, 62, and 64 of tank 58 described above and shown in FIGS. 1 and 2 for example, or rigid tank sidewall 81 described below and shown in FIGS. 12*a*, 12*b* and 12*c* for example.

The elastic wall typically is indicated generally in the figures by the designating numeral 66. As shown in FIGS. 1, 2*a*, 2*b*, 10, and 14 for example, elastic wall 66 can comprise an inflatable U-shaped member 68. As shown in FIGS. 2*a*, 2*b*, and 10 for example, inflatable U-shaped member 68 preferably comprises a plurality of internal webs 70 which subdivide the interior space of member 68 into a plurality of compartments 72*a*, 72*b* and 72*c*. At least a single web 70 defines two compartments 72, and the lower compartments are the ones closer to diffuser board 52. In some embodiments, the upper compartments can be separately pressurizable from the lower ones.

Figure 3B:
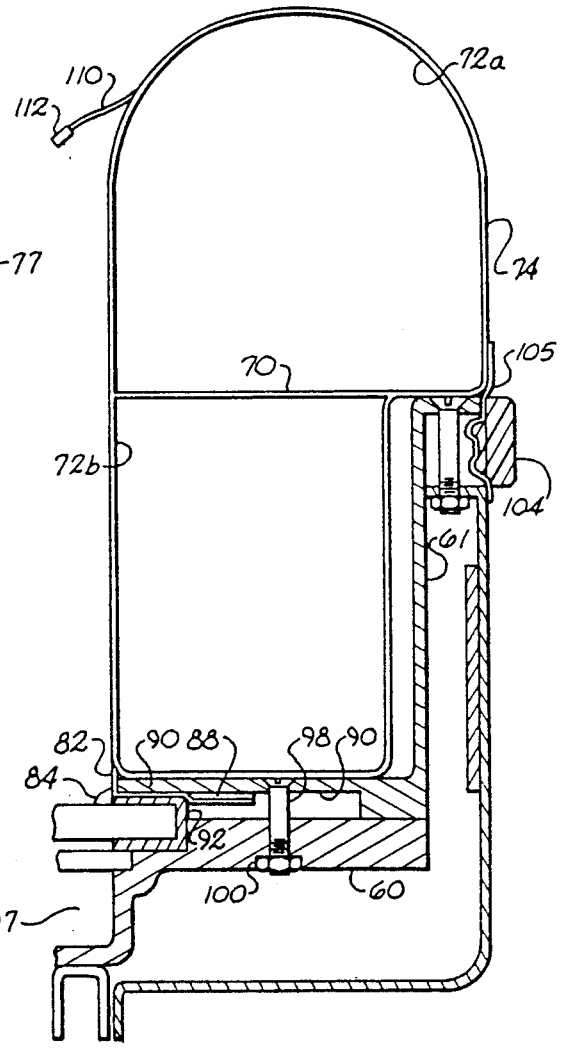
FIG. 3*b* illustrates a partial, detailed cross-sectional view of components of an embodiment of the present invention taken in a direction similar to the lines 2—2 of FIG. 1.

In the embodiments of elastic wall 66 illustrated in FIGS. 2*a*, 2*b*, 3*b*, 4, 6, and 10 for example, the uppermost compartment 72*a* is larger than the lower compartments 72*b*, 72*c* and forms an overhanging portion 74 which extends over the free edge of sidewalls 61, 62 and end wall 64 of tank 58. As shown in FIG. 3*b* for example, an elastomeric fastener 104 retains a securing flap 105 by press fitting flap 104 into a receptacle therefor, and so secures the elastic wall to the sidewall of the tank. In an embodiment such as shown in FIG. 7 for example, all compartments 72 are similarly configured. As shown in FIG. 2*c* for example, an embodiment of an uppermost compartment 76 has a hemispherical shape and does not have an overhanging portion.

Figure 3C:
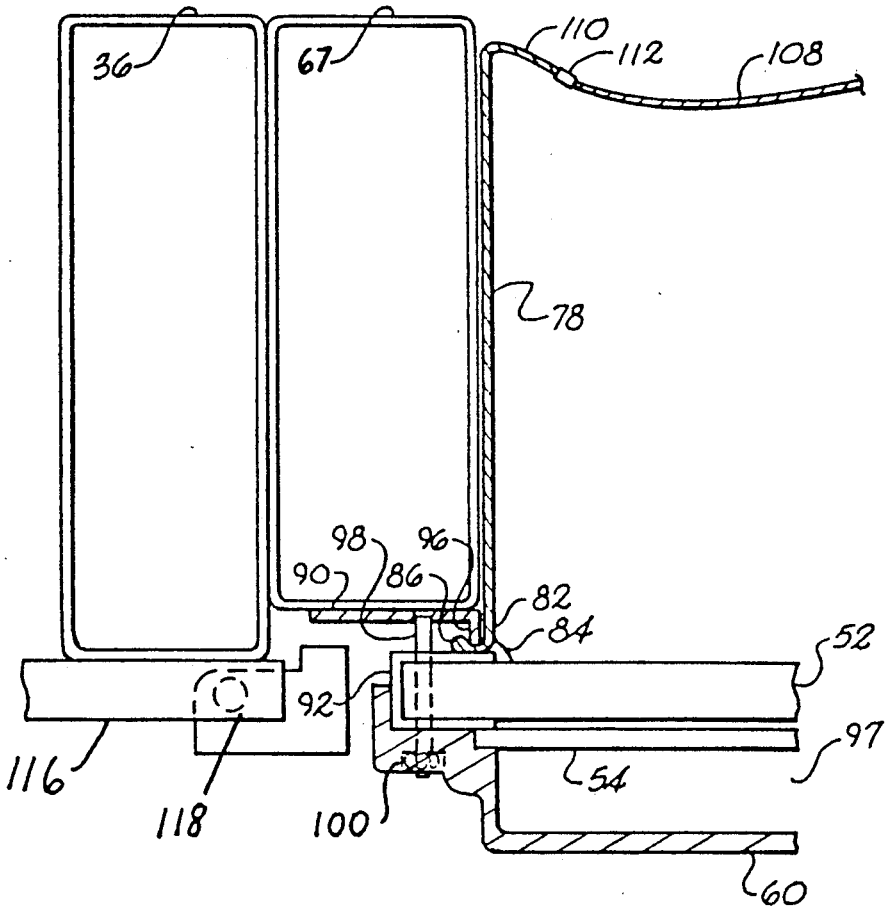
FIG. 3*c* illustrates a detailed cross-sectional view of components of an embodiment of the present invention taken along the lines 3—3 of FIG. 1.
Figure 14:
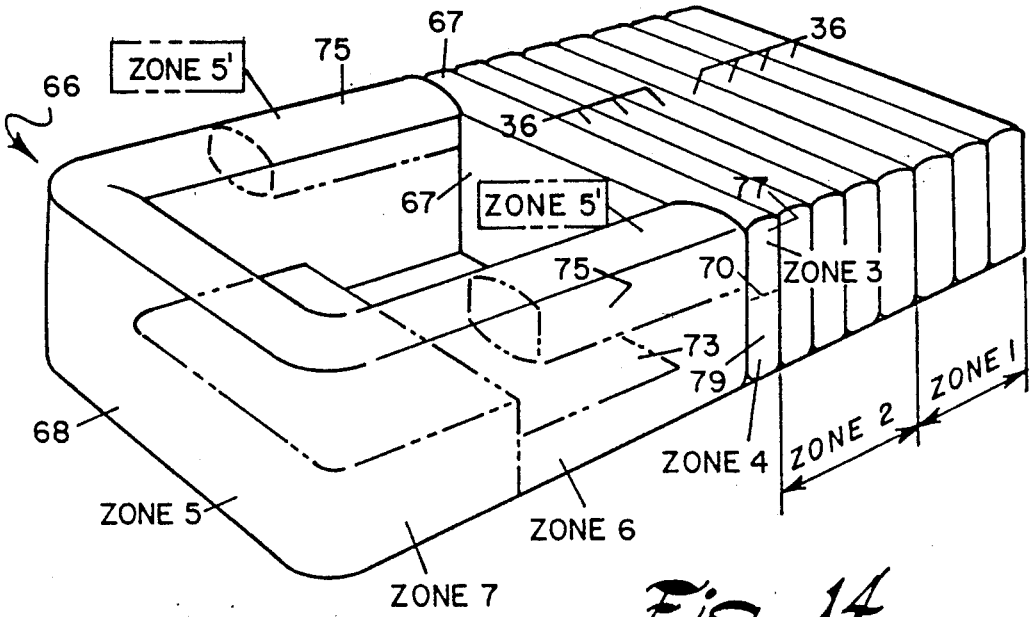
FIG. 14 illustrates a perspective view of components of an embodiment of the present invention.

In still further accordance with the present invention, the means for laterally retaining the fluidizable medium generally above the supporting and diffusing means can include an interface- member disposed to separate the fluidizable material from the first surface. The interface member can be disposed across an at least partially open end of the tank so as to prevent passage of air and fluidizable material between the interface member and the diffuser board and between the interface member and the tank sidewalls. As embodied herein, the interface member can include an inflatable interface sack 67. As shown in FIGS. 3*a*, 3*c*, 8, 9 and 14 for example, elastic wall 66 can include an inflatable interface sack 67 extending across the open end of tank 58 and providing the interface between the fluidizable material 50 and the first surface formed by inflatable sacks 36 or mattress 142. As shown in FIGS. 3*a*, 8, 9, and 14 for example, interface sack 67 preferably includes two compartments 77, 79 which are separated by web 70 and separately pressurizable. As shown in FIG. 3*c* for example, interface sack 67 need have only a single inflatable compartment. As shown in FIG. 14 for example, elastic wall 66 can comprise interface sack 67 and U-shaped member 68.

In one alternative preferred embodiment shown in FIG. 14 for example, U-shaped member 68 comprises upper compartments 75 (shown in phantom) and lower compartment 73. Interface sack 67 is disposed across the open end of U-shaped member 68. By supplying air to each of compartments 73, 75, 77, and 79 via a separate pressure valve 46, the lower compartments 73, 79 can be maintained at a higher pressure than the upper compartments 75, 77. This facilitates enhancing the comfort of the patient coming into contact with upper compartments 75, 77, while providing more rigidity to lower compartments 73, 79, which bear more of the pressure of laterally retaining fluidizable material 50. The lower pressure renders upper compartments 75, 77 more deformable than the lower compartments and thereby facilitates patient ingress and egress to and from the fluidizable support.

In another preferred embodiment shown in FIG. 14 for example, U-shaped member 68 has no internal, separately pressurizable compartments 75. This facilitates manufacture and eliminates the need for separate valving for the separate compartments, thus further reducing costs. In this embodiment, the entire U-shaped member is deflated sufficiently to permit patient ingress and egress.

Interface sack 67 can be integrally formed with U-shaped member 68 by having common exterior wall panels. In other embodiments, the exterior wall panels of U-shaped member 68 and interface sack 67 can be joined in air-tight fashion. As shown in FIG. 14 for example, interface sack 67 can be configured with the same exterior dimensions as inflatable sacks 36 and is largely indistinguishable from same when judged by outward appearances. However, as shown in FIG. 3*c* for example, interface sack 67 can be configured with slightly different exterior dimensions as inflatable sacks 36 in order to accommodate the disposition of articulatable member 116 adjacent the second surface formed of fluidizable material.

Figure 18:
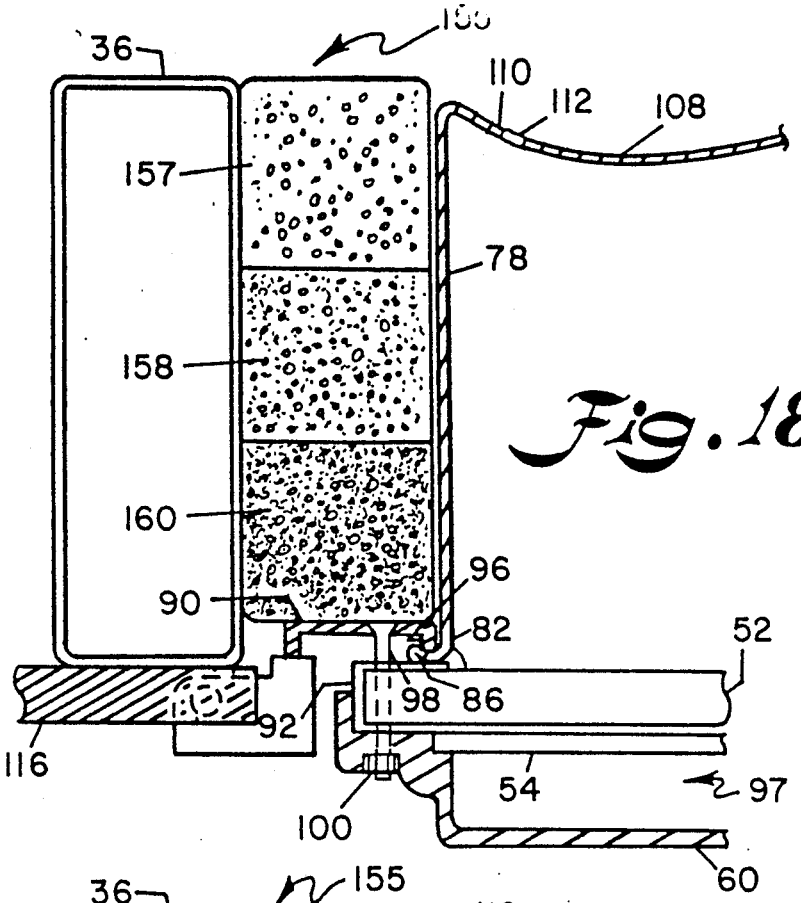
FIG. 18 illustrates a perspective view of a further alternative preferred embodiment of the present invention.

As embodied herein, the interface member can include a non-rigid panel which can form an inner liner for tank 58 for example. As shown in FIGS. 3*c*, 10, 12*a*, 12*b*, 12*c*, 16, 17, and 18, one alternative embodiment of elastic wall 66 comprises a non-rigid panel 78 which is impermeable to the passage of both air and fluidizable material. Panel 78 preferably is formed of a fabric coated with polyurethane, vinyl or the like. As shown in FIG. 3*c* for example, panel 78 can rest against an inflatable interface sack 67, which together with the other inflatable sacks 36 provide sufficient rigidity to retain the fluidizable material generally above diffuser board 52. As shown in FIGS. 10 and 16 for example, panel 78 can rest at least partially against mattress 142, which provides sufficient rigidity to retain the fluidizable material generally above diffuser board 52. As shown in FIG. 18 for example, panel 78 can rest at least partially against a polyurethane foam member 155 (described hereafter), which provides sufficient rigidity to retain the fluidizable material generally above diffuser board 52.

Figure 19:
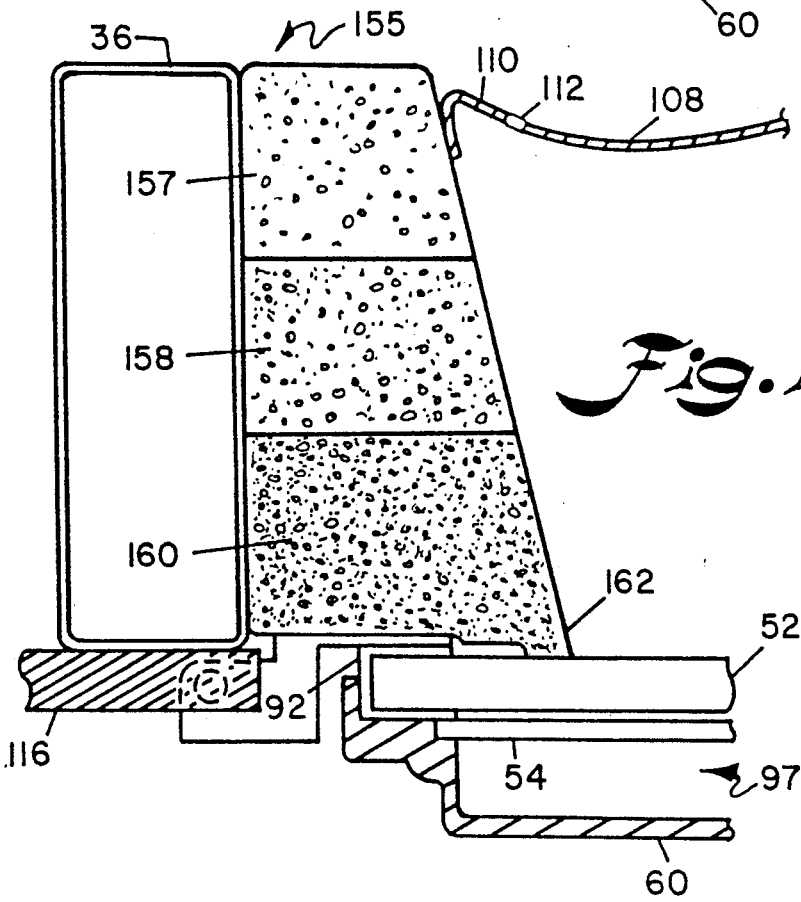
FIG. 19 illustrates a perspective view of yet another alternative preferred embodiment of the present invention.

The interface member also can include a polyurethane member. As embodied herein and shown in FIGS. 18 and 19 for example, the interface member can include a polyurethane member, which is indicated generally by the numeral 155. Polyurethane member 155 can be disposed between the fluidizable material and the first surface. As shown in FIGS. 18 and 19 for example, one side of polyurethane member 155 rests against the first surface formed by inflatable sacks 36. However, mattress 142 can just as easily form the first surface and rest against one side of polyurethane member 155.

Polyurethane member 155 preferably is integrally formed of separate blocks of polyurethane foam which are joined together by a suitable adhesive. As shown in FIGS. 18 and 19 for example, three foam blocks 157, 158, and 160, are stacked one above the other. Preferably, the three foam blocks are arranged relative to one another so that the relative compressibility of the blocks increases from top to bottom. In other words, lowermost block 160 is the most resistant to the compressive forces applied by the fluidizable material. This can be accomplished by varying the density of the blocks so that the density of lowermost block 160 is the greatest and the density of uppermost block 157 is the least. This also can be accomplished by varying the stiffness or relative compressibility of the blocks so that the lowermost block 160 is formed of polyurethane foam having the greatest resistance to the compressive forces exerted by the fluidizable material and the uppermost block 157 is formed of polyurethane foam having the least resistance to the compressive forces exerted by the fluidizable material. In this way, the uppermost block provides a relatively deformable and comfortable surface beneath the patient.

The compressibility also can be varied by varying the thickness of the polyurethane member as a function of its height. In an alternative embodiment of polyurethane member 155 shown in FIG. 19 for example, the thickness profile of the polyurethane member increases from top to bottom. Though not shown in FIG. 19, a single block of uniform composition and uniform density could form the polyurethane member of varying thickness with height. Thus, the thickness of the base of polyurethane member 155 is longer than the thickness of the top of member 155. In this way, the thickness of the polyurethane member is greatest where it is subjected to the greatest depth of fluidizable material. This is where the greatest compressive forces are applied to member 155 by the weight of the fluidizable material. In embodiments of polyurethane member 155 such as shown in FIG. 19 for example, the foot portion 162 of member 155 must be securely anchored to diffuser board 52 in order to prevent leakage of the fluidizable material past member 155. This can be accomplished by a suitable conventional adhesive, which also can be used to attach an attachment flap 110 to the uppermost block 157 of member 155.

Figure 6:
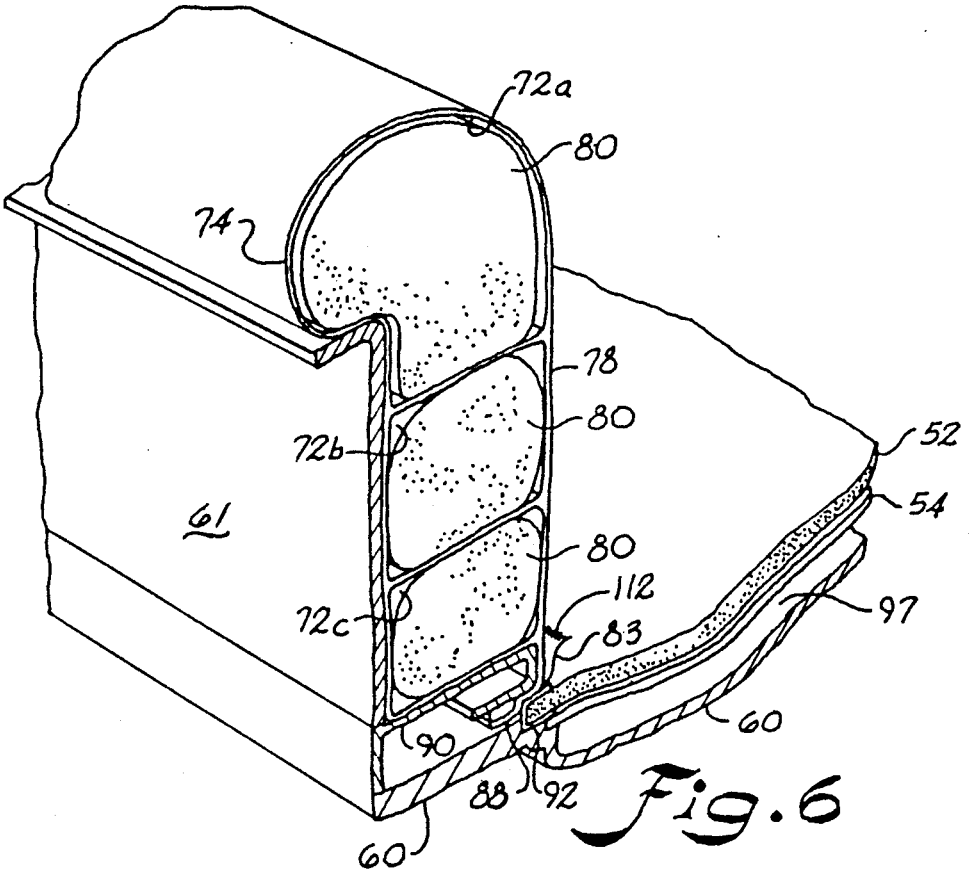
FIG. 6 illustrates a perspective, cut-away view of components of an embodiment of the present invention.

As shown in FIG. 6 for example, an embodiment of elastic wall 66 can include a plurality of deformable inserts 80 disposed within and substantially filling each compartment formed by an embodiment of impermeable panel 78 which has been configured to completely envelope inserts 80. Each insert 80 preferably is formed of polyurethane foam or a polymeric deformable material. Moreover, some compartments can include an insert 80, while other compartments need not include an insert 80.

Figure 12A:
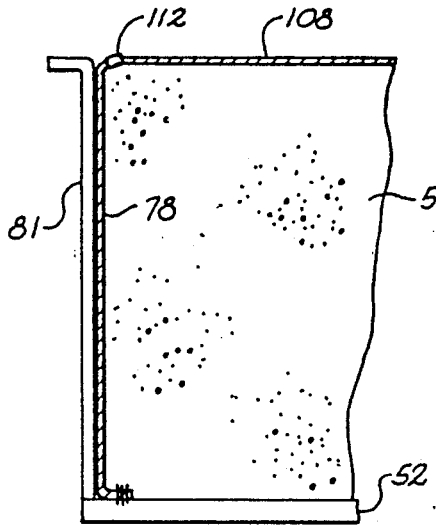
FIG. 12*a* illustrates a partial cross-sectional view of components of an embodiment of the present invention in a fluidized state.
Figure 12B:
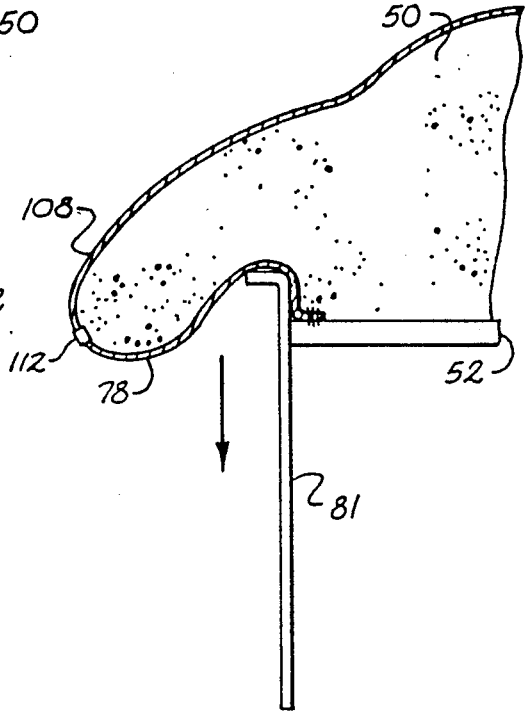
FIG. 12*b* illustrates a partial cross-sectional view of components of an embodiment of the present invention in a defluidized state.
Figure 12C:
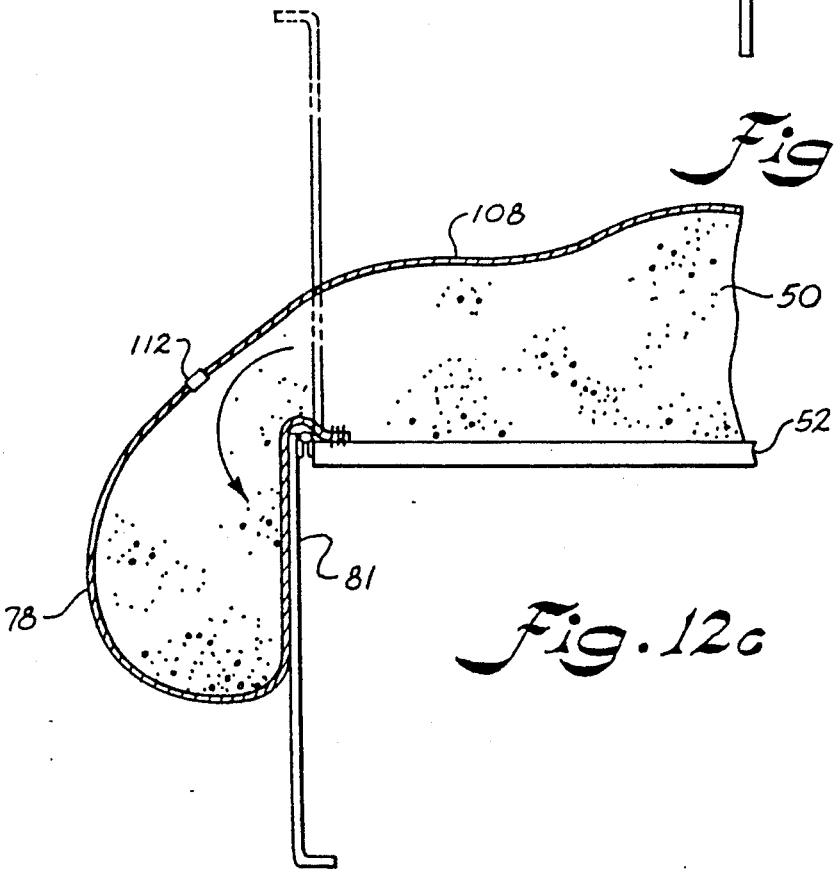
FIG. 12*c* illustrates a partial cross-sectional view of components of an embodiment of the present invention in a defluidized state.

As shown in FIGS. 12*a*–12*c* for example, the means for laterally retaining the fluidizable material over a predetermined air permeable section of the plenum defining means can include a rigid tank sidewall 81, and an elastic wall embodiment such as a flexible impermeable panel 78. An air permeable sheet 108 can be connected to air impermeable panel 78. Though not shown in FIG. 12, panel 78 can be disposed without interruption around the sides and closed end of tank 58, and an interface sack 67 can be used to retain the fluidizable material at the open end of tank 58. In other embodiments, panel 78 completely surrounds the fluidizable material.

Figure 5:
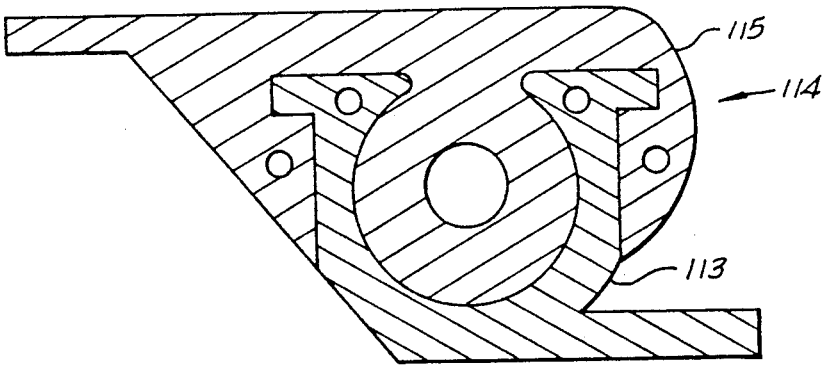
FIG. 5 illustrates a cross-sectional view of components of an embodiment of the present invention.

In order to facilitate patient ingress to and egress from the patient support system, at least a section of rigid sidewall 81 is selectively collapsible, either via a grooved track mechanism as illustrated schematically in FIG. 12*b* or by a bottom hinged mechanism illustrated schematically in FIG. 12*c*. Air permeable sheet 108 is impermeable to passage of fluidizable material therethrough and is joined at its periphery to panel 78 by an air tight means of attachment such as an air tight zipper 112 or an elastomeric attachment 114 (FIG. 5).

Figure 4:
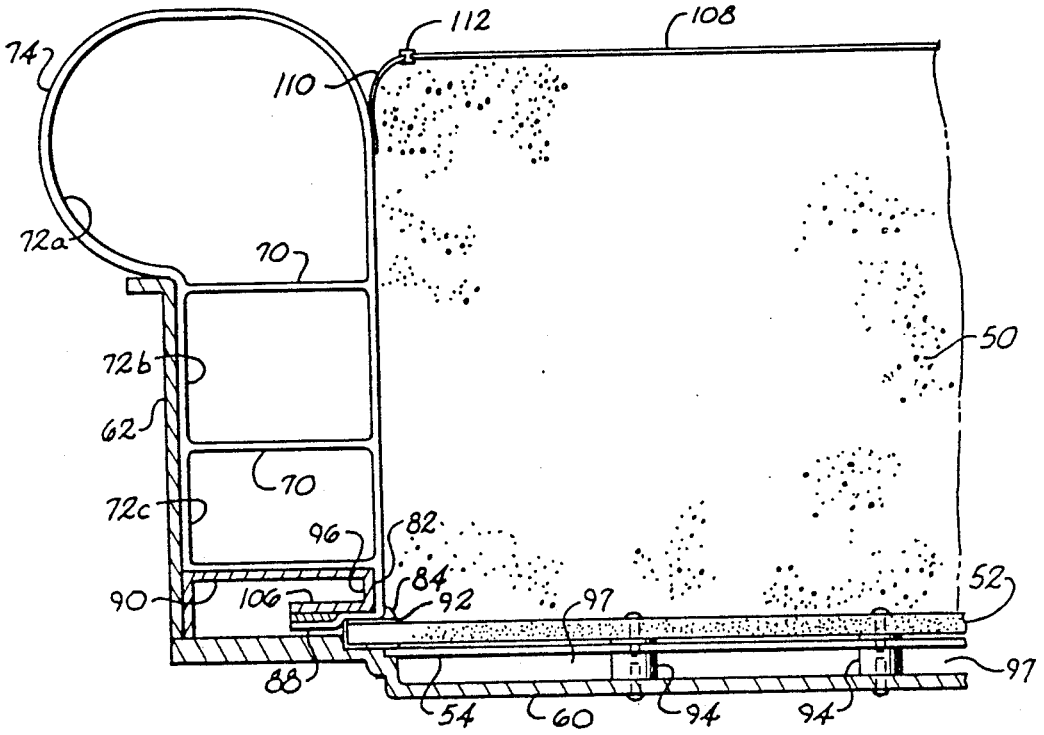
FIG. 4 illustrates a partial, detailed cross-sectional view of components of an embodiment of the present invention in a fluidized state taken along the lines 4—4 of FIG. 1.

The manner by which the retaining means confines the fluidizable medium generally above the supporting and diffusing means is most easily explained by reference to FIGS. 3 and 4 for example. The elastic wall has an attachment flap 82. The free end of attachment flap 82 has an anchoring member, which can for example be a cord 86 in some embodiments (FIGS. 3*c*, and 7) or a hook and loop type fastener strip 88, such as a VELCRO TM strip, in others (FIGS. 3*a*, 3*b*, 4, and 6). As shown in FIGS. 3*a*, 3*b*, 4, and 6 for example, a rigid clamping channel 90 rests atop tank bottom 60. The free edge of diffuser board 52 is surrounded by a silicone rubber sleeve 92 to form an air-impermeable fitting around the entire free edge of diffuser board 52. In a preferred embodiment, a plurality of support posts 94 (FIG. 4) separates diffuser board 52 and perforated metal plate 54 from tank bottom 60 and support diffuser board 52 and plate 54 above tank bottom 60. Attachment flap 82 extends between the outer surface of an inner leg 96 of clamping channel 90 and sleeve 92. Then attachment flap 82 extends around inner leg 96 so that the anchoring member (86 or 88) extends beyond the inner surface of inner leg 96 as shown in FIGS. 3*c* and 4 for example. Clamping channel 90 is secured to tank bottom 60 via a clamping bolt 98 and a nut 100. Thus, attachment flap 82 is secured in air tight fashion between tank bottom 60 and the free end of inner leg 96 of clamping channel 90. A bead 84 of an air impermeable sealant is applied between sleeve 92 of diffuser board 52 and elastic wall 66. Bead 84 preferably is formed of any room temperature vulcanizing compound (RTV), such as a silicone rubber composition which hardens after exposure to air at room temperature. In this way, air entering a plenum 97 formed between diffuser board 52 and tank bottom 60 cannot escape past the free edge of diffuser board 52 or inner leg 96 of clamping channel 90. Furthermore, elastic wall 66 is air impermeable. Thus, air entering plenum 97 under pressure from blower 40 must pass up through diffuser board 52 into the fluidizable material supported thereabove.

FIG. 3*a* illustrates one embodiment of interface sack 67 of elastic wall 66 which extends across the open end of tank 58. Tank bottom 60 supports the free edges of perforated plate 54 and diffuser board 52, and silicone rubber sleeve 92 surrounds the free edge of diffuser board 52 to prevent air from escaping through the free edge of diffuser board 52. A clamping channel 90 secures and seals attachment flap 82 against sleeve 92 in an air-tight fashion and has an anchoring flange 106. In this embodiment, the anchoring member comprises a hook and loop type fastener strip 88 which attaches to a mating hook and loop strip secured to the underside of anchoring flange 106 of clamping channel 90. Clamping bolts 98 are used to secure clamping channel 90 against tank bottom 60 and diffuser board 52. Moreover, clamping channel 90 can be provided with openings (not shown) through which tubes (not shown) or other conduits for supplying gas to elastic wall 66 can be passed.

FIGS. 3*c* and 10 illustrate another preferred embodiment of elastic wall 66 which extends across the open end of tank 58. Tank bottom 60 supports the free edges of perforated plate 54 and diffuser board 52, and silicone rubber sleeve 92 surrounds the free edge of diffuser board 52 to prevent air from escaping through the free edge thereof. A clamping member 90 secures and seals attachment flap 82 of panel 78 against sleeve 92 in an air-tight fashion and has an inner leg 96. As shown in FIG. 3*c* in this embodiment, the anchoring member comprises a cord 86 which rests against the inner surface of inner leg 96. Clamping channel 90 is secured to tank bottom 60 via a clamping bolt 98 and nut 100. Thus, attachment flap 82 is secured in air-tight fashion between inner leg 96 of clamping channel 90 and silicone sleeve 92. A bead 84 of RTV can be applied between sleeve 92 and flexible panel 78. In this way, air entering a plenum 97 formed between diffuser board 52 and tank bottom 60 cannot escape past the free edge of diffuser board 52 or inner leg 96 of clamping channel 90. Furthermore, air impermeable panel 78 forces air entering plenum 97 and passing through diffuser board 52 to pass through the fluidizable material before exiting through an air permeable sheet 108 connected to panel 78 via an air-tight zipper 112 for example.

In still further accordance with the present invention, there is provided a flexible cover sheet. As embodied herein and shown in FIGS. 1, 2, 3*c*, 4, 7, 8, 9, 12, 18 and 19 for example, the flexible cover sheet is o formed by an air permeable sheet 108, which is connected to the retaining means so as to contain the fluidizable material and simultaneously permit the fluidizing air to escape. Air permeable sheet 108 is preferably formed of a fine mesh fabric that is impermeable to the passage of the fluidizable material therethrough. Air permeable sheet 108, the laterally retaining means, and the supporting and diffusing means are connected to one another and thereby cooperate to provide means for containing the fluidizable medium and for permitting the diffusion of air therethrough to achieve fluidization of the fluidizable material.

In further accordance with the present invention, means are provided for detachably attaching the periphery of the air permeable cover sheet to the retaining means so as to prevent passage of the fluidizable material past this sheet attaching means. The sheet attaching means preferably prevents passage of particles therethrough having a narrowest dimension greater than 30 microns. The sheet attaching means is further preferably configured so as to be easily engagable and disengagable without great manual strength or dexterity. As embodied herein and shown in FIG. 12 for example, the sheet attaching means includes an attachment mechanism such as an airtight zipper 112. In an alternative embodiment shown in FIGS. 3, 4, and 10 for example, the means for attaching sheet 108 to the retaining means preferably includes a flexible attachment flap 110 connected to an attachment mechanism such as an air-tight zipper 112. Attachment flap 110 preferably is impermeable to the passage of air therethrough and to the passage of fluidizable material therethrough.

An alternative embodiment of an attachment mechanism is generally designated by the numeral 114 illustrated in FIG. 5 for example, and comprises an elastomeric interlocking mechanism. Mechanism 114 includes two mating elastomeric members 113, 115, and both members join together to form an air-tight seal. The two elastomeric members are easily deformable to come apart and join together under the manipulation of human hands. The ease with which the embodiments of the sheet attaching means can be engaged and disengaged by hand greatly facilitates the removal of the fluidizable material whenever replacement is desireable. It also greatly facilitates replacement of air permeable sheet 108 whenever soiling of same requires that it be changed.

In accordance with the present invention, means are provided for supplying air at a plurality of independently determinable pressures to separate pressure zones of the patient support system and at a plurality of independently determinable air flow rates to separate flow rate zones of the patient support system. In a preferred embodiment illustrated in FIGS. 14 and 15 for example, the various facilities of the patient support system requiring a supply of air are assigned a separate valve to facilitate effecting independent levels of pressurization and/or rates of air flow. These various facilities include air sacks 36, air plenum 97, air plenum chambers 120, 122, and interface sack 67 and the other inflatable components of elastic wall 66. Each valve segregates a separate zone, and thus air from blower 40 is provided to a plurality of separately controllable zones. Each separate zone is controlled by either a pressure control valve 46 or a flow control valve 126, 128. Each pressure control valve and flow control valve is controlled by microprocessor 130 such as shown in FIG. 13 for example. Each pressure control valve 46 has a pressure sensing device which measures the pressure at the outlet of the valve and sends a signal indicative of this pressure to microprocessor 130. As embodied herein, a transducer 127 provides a suitable pressure sensing device. Each flow control valve 126, 128 has a flow sensing device which measures the flow through each valve and sends a signal indicative of this flow to microprocessor 130. As embodied herein, an air velocity sensing device 127 is disposed to provide suitable air flow measurements. Each valve 46, 126, 128 further comprises an electrically operated motor 132 which opens and closes each valve. Microprocessor 130 controls each motor 132 of each valve, and a preselected pressure or flow for each valve can be selected and stored in the memory of microprocessor 130 via key pad 154 and control panel 156. Microprocessor 130 is programmed to control motor 132 so as to regulate the pressure or flow through the valve in accordance with the preselected value of pressure or flow stored in the memory of microprocessor 130. Similarly, microprocessor 130 can be programmed to change the preselected pressure or flow through one or more of valves 46, 126, 128.

As shown in FIG. 15, for example, individual inflatable components, such as U-shaped member 68 for example, or groups of inflatable components, such as sacks 36, can be associated with a single zone which is supplied by a single pressure control valve 46. Accordingly, all of the sacks controlled by a single pressure control valve 46 can be maintained at the same pressure by the microprocessor, which uses the valve's transducer 127 to monitor the pressure at the valve's outlet.

In one embodiment illustrated in FIGS. 14 and 15 for example, each of seven different zones is independently maintainable at a different pressure and/or flow rate of air by blower 40. Zone 1 includes a plurality of inflatable sacks 36, which preferably lack any air escape holes. Thus, the only air flowing out of the sacks is the inconsequential leakage that may emanate from the seams of the sack. Blower 40 provides sufficient air to sacks 36 in zone 1 to maintain them at a pressure between zero and twenty inches of water. Zone 2 includes a plurality of air sacks 36 without air escape holes. Because of the essentially inconsequential air leakage from the seams of the sacks in zone 2, blower 40 supplies air to these sacks 36 at a flow rate of essentially zero cubic feet per minute and a pressure that can be varied between zero and twenty inches of water. Zone 3 includes upper compartment 77 of interface sack 67, and blower 40 supplies air thereto at a pressure that can be varied between zero and twenty inches of water. Since no air escape holes are provided in interface sack 67, the flow rate of air provided to compartment 77 is essentially zero apart from some small air leakage, if any, from seams forming compartment 67. Zone 4 includes lower compartment 79 of interface sack 67, and blower 40 supplies air thereto at a pressure that can be varied between zero and twenty inches of water, and the flow rate of air is once again essentially zero. Zone 5 includes U-shaped member 68. Blower 40 supplies air to U-shaped member 68 in pressure zone 5 at a pressure that can be varied between zero and twenty inches of water, and the air flow rate is essentially nil for the same reasons mentioned above. Zone 6 is a flow rate zone and includes buttocks plenum chamber 120 of plenum 97 illustrated in FIG. 10 for example. Similarly, zone 7 includes plenum chamber 122, which is disclosed to provide air to fluidize the mass of fluidizable material 50 disposed to support the legs and feet of the patient. During fluidization of the mass of fluidizable material, blower 40 supplies air in zone 6 to buttocks plenum chamber 120 at a pressure between twelve and twenty-two inches of water and a flow rate between five and twenty cubic feet per minute. Similarly, blower 40 supplies air in zone 7 to legs and feet plenum chamber 122 during fluidization of the mass of fluidizable material thereabove at a pressure of between six and eighteen inches of water and a flow rate of between five and twenty-eight cubic feet per minute.

If it is desired to permit egress from or ingress to the patient support system, the pressure valve supplying air to U-shaped member 68 in pressure zone 5 can be controlled by microprocessor 130 through suitable controls on keypad 154 so as to reduce the pressure within U-shaped member 68. The reduced pressure permits the patient to slide relatively easily over the upper portion of U-shaped member 68.

In an alternative embodiment, a pair of upper compartments 75 (shown in phantom in FIG. 14) can be defined in U-shaped member 68. In this alternative embodiment, zone 5' is provided for upper compartments 75. Compartments 75 lack any air escape holes, and blower 40 supplies air to compartments 75 at a pressure that can be varied between zero and twenty inches of water and a flow rate of essentially zero cubic feet per minute. In this alternative embodiment, zone 5 includes only lower compartment 73 of U-shaped member 68, and compartment 73 lacks any air escape holes. If it is desired to permit egress from or ingress to the patient support system embodiment shown in FIG. 14 for example, the pressure control valve supplying air to compartments 75 can be controlled by microprocessor 130 through suitable controls on key pad 154 so as to reduce the pressure within compartments 75. The reduced pressure renders them soft enough to permit the patient to slide over them relatively easily. At the same time, the pressure control valve regulating the pressure in compartment 73 of elastic wall 66 can be maintained high enough to provide sufficient rigidity to the remainder of the elastic wall so as to prevent the fluidizable material from unduly deforming elastic wall 66 while the patient is entering or exiting the fluidizable support.

Similarly, upper compartment 77 and lower compartment 79 of interface sack 67 can be maintained at different pressures if each is supplied by a different pressure control valve 46. In this way, the lowermost compartment 79 can be maintained at a higher pressure than upper compartment 77 to facilitate retaining the mass of fluidizable material. Maintaining a lower pressure in upper compartment 77 permits it to be compressed for the comfort of the patient, or when the articulatable member is raised to form an angle of inclination with the horizontal as shown in FIG. 11 for example. The pressure in compartment 77 can be lowered automatically by suitable programming of the microprocessor to control the pressure in compartment 77 during articulation of member 116. Thus, the pressure in compartment 77 can be controlled by microprocessor 130 according to the angle of inclination of articulatable member 116.

Each control valve 46 can be operated in a so-called dump mode which permits instantaneous opening of the valve so as to permit instantaneous depressurization through the valve. Thus, pressure control valves 46 are capable of operating as would a solenoid valve insofar as depressurization is concerned. This mode of valve operation permits instantaneous deflation of inflatable sacks 36 for example. Such deflation is desirable to permit a cardiopulmonary resuscitation (CPR) procedure to be performed on a patient. Such procedure requires a rigid surface rather than the compressible surface provided by inflatable sacks 36. Key pad 154 of control panel 156 signals microprocessor to trigger the pressure control valves 46 to the dump mode.

As shown schematically in FIG. 15 for example, a heat exchange device 51 also can be provided to regulate the temperature of the air supplied to fluidize the mass of material 50. As shown schematically in FIG. 13 for example, microprocessor 130 also controls heat exchange device 51, which includes a heater 53 and a heat exchanger 55. A temperature probe 57 can be provided and disposed so as to record the temperature inside fluidizable material 50 and provide a signal to microprocessor 130. Microprocessor 130 then activates heater 53 to regulate the temperature of the mass of fluidizable material according to predetermined temperature range parameters stored in the memory of microprocessor 130. Microprocessor 130 also can display the temperature on control panel 156 for example.

Microprocessor 130 controls blower 40 via a blower control board 131 and receives signals from a pressure sensor 150 which monitors the pressure at the outlet side of blower 40. Microprocessor 130 also controls articulation of articulatable member 116 via conventional hydraulics and motors indicated schematically in FIG. 13 by the articulation package designated 152. Sensing devices also are included in this articulation package 152, as indicated schematically in FIG. 13 by the return arrow toward microprocessor 130. These sensing devices provide microprocessor 130 with information regarding the degree of articulation of articulatable member 116.

In yet further accordance with the present invention, means are provided for defluidizing the mass of fluidizable material during elevation of the articulatable member. As embodied herein and shown schematically in FIG. 13 for example, the means for defluidizing the mass of fluidizable material during elevation of the articulatable member preferably includes articulation package 152 and microprocessor 130. As embodied herein, articulation package 152 contains conventional hydraulics and motors to raise articulatable member 116 and further includes sensing devices to monitor the degree of articulation of member 116. Instructions concerning the degree of elevation of articulation member 116 are inputted to microprocessor 130 by the operator via key pad 154 and control panel 156. Microprocessor 130 then activates the conventional hydraulics and motors until the articulation sensing device signals that the inputted level of articulation has been attained. In conjunction with the actuation of the conventional hydraulics and motors to begin elevating articulatable member 116, microprocessor 130 causes flow control valve 126 governing fluidization of buttocks plenum chamber 120 (shown in FIG. 10 for example) to close. This defluidizes the mass of fluidizable material supporting the buttocks of the patient. The defluidization of material 50 supporting the buttocks of the patient acts to prevent the buttocks from moving in a direction toward the feet of the patient as weight is transferred against the buttocks during elevation of the head and chest of the patient. Thus, the defluidization of the mass of fluidizable material supporting the buttocks acts as a substitute for a knee gatch that often is required when elevating the head and chest of a patient on the articulatable member of a conventional low air loss bed. The prevention of movement of the buttocks has the added beneficial result of restraining the patient from any slipping and sliding that might cause tissue damage to any sacral skin grafts which may exist on the patient.

After the articulatable member has attained the desired angle of elevation, the microprocessor opens the valves supplying air to the mass of fluidizable material so as to refluidize the material. Alternatively, the microprocessor can be programmed to signal flow control valve 126 to open for a very brief period of time. The duration of this brief period is no longer than required to contour the mass of fluidizable material for supporting the buttocks in the sitting position which has been attained by the patient. For example, the duration of this brief period is not long enough to result in the patient feeling the sensation of sinking into the mass of fluidizable material in the buttocks zone.

Typically, when the articulatable member of the frame is moved from an elevated position at which the mass of fluidizable material has been fluidized, the level of fluidization of the fluidizable material is maintained during lowering of the articulatable member to a less elevated angular position.

In still further accordance with the present invention, means are provided for containing the fluidizable medium. As embodied herein and shown in FIGS. *2b*, 4, and 12 for example, the means for containing the fluidizable medium can include an embodiment of elastic wall 66, air permeable sheet 108, and diffuser board 52. Another embodiment of the means for containing the fluidizable medium is shown in FIGS. 7–9 for example and preferably includes at least one fluidizable cell 134, and preferably a plurality of cells 134, can be provided to contain the fluidizable medium. Each fluidizable cell 134 has an upper wall 136, a lower wall 138, and a sidewall 140 extending between and connecting the upper wall and the lower wall. Each cell 134 contains a mass of fluidizable material 50 therein, and walls 136, 138, and 140 prevent passage of the fluidizable material therethrough. Each upper wall 136 and each lower wall 138 of each fluidizable cell 134 is permeable to the passage of air therethrough. Each sidewall 140 of each fluidizable cell 134 is impermeable to passage of air therethrough.

The upper walls are connected in air impermeable fashion to the laterally retaining means surrounding the cells. An air impermeable seal is formed between the elastic wall and at least a portion of the periphery of each upper wall 136 of each fluidizable cell 134. This is preferably accomplished as shown in FIGS. 8 and 9 for example, in which each fluidizable cell 134 is connected to the retaining means such as elastic walls 66 via an attachment flap 110 and an attachment mechanism such as air-tight zipper 112. Each upper wall 136 of each fluidizable cell preferably is formed as a disengagable section of an air permeable cover sheet 108. Preferably, the remaining portion of the periphery of each upper wall 136 is connected to the remaining portion of the periphery of each upper wall of each adjacent fluidizable cell 134 via respective attachment flaps 110 and zippers 112 for example. In an alternative embodiment shown in FIGS. 8 and 9 for example, hook and loop type fastener strips 88 are provided to connect adjacent sidewalls 140 of adjacent cells 134. These strips 88 preferably are located near the interface between upper wall 136 and sidewall 140 of each cell 134. In this way all of the upper walls 136 of cells 134 are connected to and/or disposed alongside one another.

In another alternative embodiment shown in FIG. 7 for example, the adjacent cells are connected to one another at the vertical edges of the narrow ends of sidewalls 140 via attachment flaps 110 and an attachment mechanism such as zippers 112. Since all of the cells are connected to one another, the upper walls 136 of cells 134 are combined to form an air permeable surface which functions like air permeable sheet 108 to prevent passage of the fluidizable material therethrough while at the same time permitting passage of air therethrough in order to allow air to pass through fluidizable material 50 and fluidize same.

In accordance with the present invention, means are provided for connecting the fluidizable cells to diffuser board 52. As embodied herein and shown in FIGS. 7, 8, and 9 for example, the means for connecting the fluidizable cells to diffuser board 52 preferably includes an attachment flap 82, an anchoring flap 83, and a means for securing the attachment flap to the anchoring flap without permitting passage of air thereby. Preferably, the lower portion of sidewall 140 near lower wall 138 of each fluidizable cell has an attachment flap 82. One end of an anchoring flap 83 is secured to diffuser board 52. Where there are a plurality of fluidizable cells, the attachment flap of the fluidizable cell closest to elastic wall 66 attaches via an embodiment of the connecting means to the anchoring flap which extends from the edge of diffuser board 52. In an alternative embodiment shown in FIG. 6 for example, anchoring flap 83 extends from the base of the elastic wall instead of from the diffuser board. In both cases, the flow of air through the diffuser board is constrained to pass through lower walls 138 of cells 134 and cannot leak between cells 134 and elastic wall 66 for example.

As embodied herein and shown in FIGS. 8 and 9 for example, the means for attaching the attachment flap to the anchoring flap preferably comprises an air impermeable zipper 112. An alternative embodiment of the attaching means includes an airtight elastomeric attachment mechanism 114 such as shown in FIG. 5 for example. In either case, the connecting means is selectively engagable and disengagable to permit removal of each fluidizable cell and substitution of a replacement fluidizable cell for the removed cell.

As shown in FIGS. 7, 8, and 9 for example, a plurality of fluidizable cells can be disposed transversely across diffuser board 52 and connected thereto via attachment flaps 82 located on sidewall 140 near lower wall 138 of each cell 134 and anchoring flaps 83 disposed in spaced relation on diffuser board 52.

The further particulars of the fluidizable cells and their relationship to the rest of the support system and to one another is set forth in copending application Ser. No. 07/443,661 filed on Nov. 29, 1989, which patent application is hereby incorporated herein by reference.

It will be apparent to those skilled in the art that various modifications and variations can be made in the present invention without departing from the scope or spirit of the invention. Thus, it is intended that the present invention cover the modifications and variations of this invention provided they come within the scope of the appended claims and their equivalents.

What is claimed is:

1. A fluidized bed patient support system, comprising:
(a) a frame;
(b) a first surface carried by said frame to support at least a first portion of the patient's body;
(c) a fluidizable medium carried by said frame adjacent said first surface to support a second portion of the patient's body;
(d) means for containing said fluidizable medium and for permitting the diffusion of air therethrough, said containing and diffusing means being carried by said frame; and
(e) wherein said containing and diffusing means includes an elastic interface member disposed between said first surface and said fluidizable medium and disposed to support a portion of the patient's body located between said first portion and said second portion.

2. An apparatus as in claim 1, wherein:
said first surface is formed at least in part by a mattress.

3. An apparatus as in claim 1, wherein:
said first surface is formed at least in part by a polyurethane foam member.

4. A fluidized bed patient support system, comprising:
(a) a frame;
(b) a first surface carried by said frame to support at least a first portion of the patient's body;
(c) a fluidizable medium carried by said frame adjacent said first surface to support a second portion of the patient's body;
(d) means for supporting said fluidizable medium and for diffusing air therethrough, said supporting and diffusing means being carried by said frame;
(e) means for laterally retaining said fluidizable medium generally above said supporting and diffusing means, said retaining means being carried by said frame; and
(f) wherein said laterally retaining means includes an elastic interface member disposed between said first surface and said fluidizable medium and disposed to support a portion of the patient's body located between said first portion and said second portion.

5. An apparatus as in claim 4, wherein:
said first surface is formed at least in part by a mattress.

6. An apparatus as in claim 4, wherein:
said first surface is formed at least in part by a polyurethane foam member.

7. An apparatus as in claim 4, wherein:
said means for laterally retaining said fluidizable medium generally above said supporting and diffusing means includes an elastic wall surrounding said supporting and diffusing means and extending in a direction substantially normally thereto, at least a portion of said elastic wall separating said fluidizable medium from said first surface.

8. An apparatus as in claim 7, wherein:
said elastic wall includes a substantially air impermeable envelope forming an inflatable member.

9. An apparatus as in claim 7, wherein:
said elastic wall includes a deformable foam member.
10. An apparatus as in claim 7, wherein:
said elastic wall includes a deformable foam member and a substantially air impermeable envelope surrounding said foam member.
11. An apparatus as in claim 4, further comprising:
means for defining an air plenum beneath said supporting and diffusing means, said air plenum defining means being carried by said frame and being divided into at least two separate chambers; and
means for fluidizing said fluidizable medium, said fluidizing means communicating with said plenum defining means.
12. An apparatus as in claim 11, wherein:
said plenum defining means having a first tier disposed above one of said separate plenum chambers and a second tier disposed above a second of said separate plenum chambers.
13. An apparatus as in claim 12, wherein:
the depth of fluidizable material supported above said first tier is greater than the depth of fluidizable material supported above said second tier.
14. An apparatus as in claim 13, wherein:
said first tier is disposed to support the patient's buttocks and said second tier is disposed to support the patient's legs and feet.
15. An apparatus as in claim 11, wherein: at least one of said separate plenum chambers being disposed to supply air to fluidize said fluidizable material for supporting the buttocks of the patient.
16. An apparatus as in claim 11, further comprising:
means for supplying air to each said plenum chamber at independently preselected air flow rates.
17. An apparatus as in claim 16, further comprising:
means for intermittently supplying air flow to at least one of said plenum chambers.
18. An apparatus as in claim 4, further comprising:
an air permeable sheet connected to said retaining means so as to prevent passage of fluidizable material between said retaining means and said sheet, said sheet being impermeable to passage of said fluidizable material therethrough; and
means for detachably attaching said sheet to said retaining means so as to prevent passage of said fluidizable medium past said attaching means.
19. An apparatus as in claim 18, wherein:
said attaching means includes an air tight zipper.
20. An apparatus as in claim 18, wherein:
said attaching means includes a pair of mating elastomeric members.
21. An apparatus as in claim 4, further comprising:
an articulatable member carried by said frame; and
means for defluidizing said mass of fluidizable material during elevation of said articulatable member.
22. A patient support system, comprising:
(a) a frame;
(b) a first surface carried by said frame to support at least a first portion of the patient's body;
(c) a tank carried by said frame and having a bottom, a pair of opposite sidewalls, a closed end wall, an open top, and one open end being at least partially open;
(d) a diffuser board disposed above said tank bottom and forming a plenum between said tank bottom and said diffuser board, said diffuser board being permeable to passage of air therethrough;
(e) a mass of fluidizable material supported by said diffuser board, said diffuser board being impermeable to passage of said material therethrough;
(f) an interface member being disposed across said at least partially open end of said tank so as to prevent passage of air and fluidizable material between said interface member and said diffuser board and between said interface member and said tank sidewalls, said interface member separating said fluidizable material from said first surface; and
(g) an air permeable sheet covering said fluidizable material, said sheet being impermeable to passage of said fluidizable material therethrough, at least a portion of the edge of said sheet being attached to said interface member so as to prevent passage of fluidizable material between said interface member and said edge portion of said sheet.
23. An apparatus as in claim 22, wherein:
said interface member comprising an inflatable sack disposed at said at least partially open end of said tank and having at least two separately pressurizable compartments, one of said compartments being disposed above the other of said compartments.
24. An apparatus as in claim 23, further comprising:
at least one deformable member disposed within at least one of said compartments.
25. An apparatus as in claim 22, wherein:
said interface member comprises a polyurethane member disposed at said at least partially open end of said tank.
26. An apparatus as in claim 25, wherein:
said polyurethane member is integrally formed such that its resistance to compression increases from top to bottom.
27. An apparatus as in claim 25, wherein:
said polyurethane member is integrally formed such that its thickness increases from top to bottom.
28. An apparatus as in claim 27, wherein:
said polyurethane member is integrally formed of at least a first block disposed above a second block, wherein the compressibility of said second block is less than the compressibility of said first block.
29. A patient support system, comprising:
(a) a frame;
(b) an articulatable member connected to said frame so as to permit articulating movement relative thereto;
(c) a first surface carried by said articulatable member to support at least a first portion of the patient's body;
(d) a tank carried by said frame and having a bottom and an open top;
(e) a diffuser board carried by said frame and disposed above said tank bottom, said diffuser board being permeable to passage of air therethrough and forming an upper wall of a plenum disposed between said diffuser board and said tank bottom; and
(f) a mass of fluidizable material supported above said diffuser board.
30. An apparatus as in claim 29, further comprising:
(g) an elastic wall disposed to extend above said diffuser board and further configured and disposed to laterally retain said fluidizable material over said diffuser board; and
(h) an air permeable sheet covering said fluidizable material, said sheet being impermeable to passage of said fluidizable material therethrough, the periphery of said sheet being connected to said elastic wall so as to prevent passage of fluidizable material between said elastic wall and said sheet.

31. An apparatus as in claim 29, wherein:

said plenum being divided into at least two separate chambers; and said diffuser board defining a first tier disposed above one of said separate plenum chambers and a second tier disposed above a second of said separate plenum chambers.

32. An apparatus as in claim 31, further comprising:

means for supplying air to each said plenum chamber at independently preselected air flow rates.

33. An apparatus as in claim 31, wherein:

at least one of said separate plenum chambers being disposed to supply air to fluidize said fluidizable material for supporting the buttocks of the patient.

34. An apparatus as in claim 33, further comprising:

means for defluidizing said mass of fluidizable material for supporting the buttocks of the patient during elevation of said articulatable section.

* * * * *